United States Patent [19]

Hughes et al.

[11] 4,198,041

[45] Apr. 15, 1980

[54] METHOD AND APPARATUS FOR HANDLING, POSITIONING AND ASSEMBLING FABRIC PLIES

[75] Inventors: Francis H. Hughes, North Troy; Kenneth O. Morton, Troy; Roger LeMere, Petersburg; Fred A. Brown, III, Ballston Spa, all of N.Y.

[73] Assignee: Cluett, Peabody & Co., Inc., New York, N.Y.

[21] Appl. No.: 858,915

[22] Filed: Dec. 8, 1977

Related U.S. Application Data

[62] Division of Ser. No. 689,995, May 26, 1976.

[51] Int. Cl.[2] ..... B65H 3/30

[52] U.S. Cl. ..... 271/9; 271/22

[58] Field of Search ..... 271/9, 21, 22, 16, 17

[56] References Cited

U.S. PATENT DOCUMENTS

| | | | |
|---|---|---|---|
| 609,437 | 8/1898 | Jillson | 271/21 X |
| 3,442,505 | 5/1969 | Szentkuti | 271/21 X |
| 3,583,695 | 6/1971 | Sherwood | 271/21 |
| 3,713,645 | 1/1973 | Ferrari | 271/21 X |
| 3,940,125 | 2/1976 | Morton | 271/21 X |

*Primary Examiner*—Richard A. Schacher

[57] ABSTRACT

The disclosure relates to new methods and means for removing fabric plies one at a time from a stack, transporting the individual plies to a secondary location, precisely orienting and aligning the plies for a subsequent operation and, in some cases assembling one ply with another in preparation for a sewing operation. In one of its advantageous forms, the equipment specifically illustrated herein is especially useful for picking individual shirt cuff and liner plies from separate supply stacks, transporting them to a load station, and assembling the plies one on top of the other, in proper alignment and orientation for sewing. In a secondary mode, the equipment of the invention may be used to transport individual fabric plies, such as entire short sleeve shirt sections, to a sewing or other processing station.

Incorporated in the comprehensive apparatus specifically disclosed are a plurality of inventive features in the form of significant sub-combinations capable of utilization in conjunction with other equipment and other processes.

4 Claims, 30 Drawing Figures

FIG.3
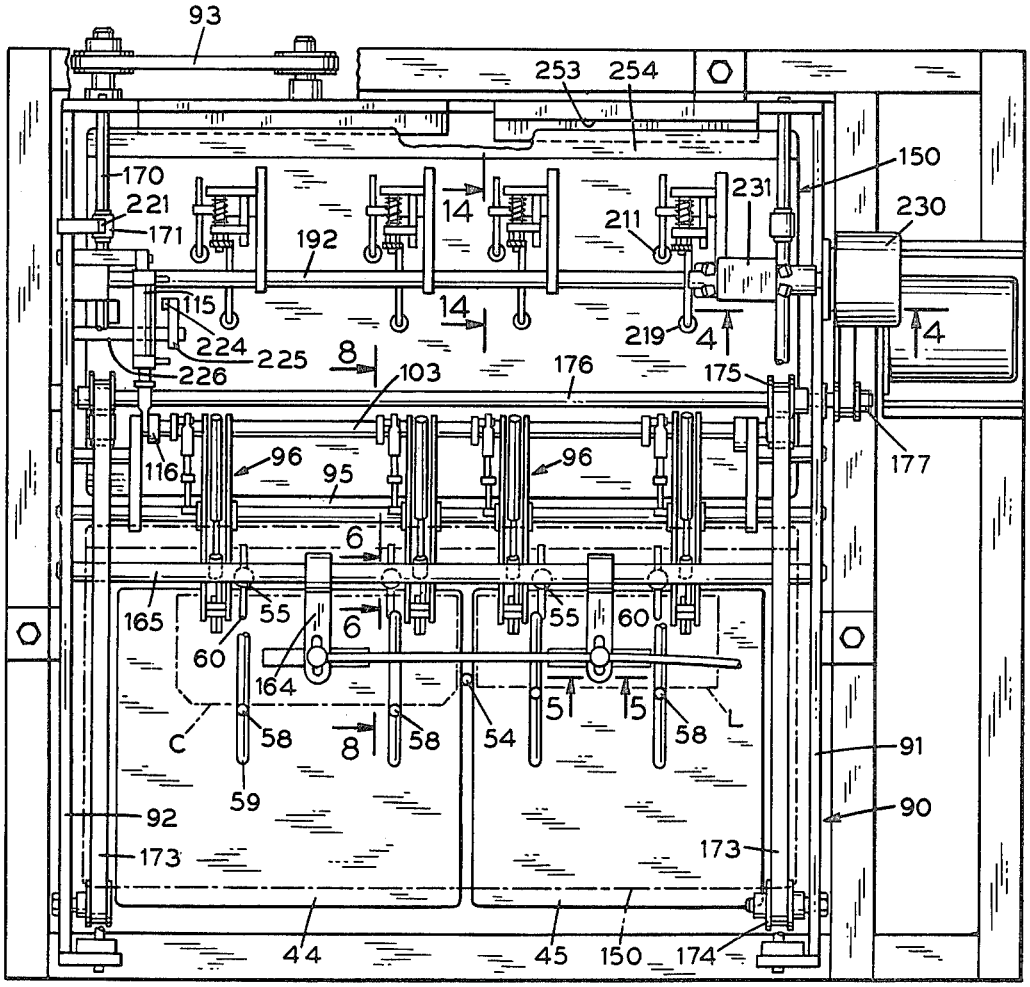
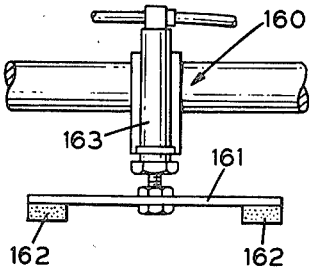
FIG.5
FIG.4
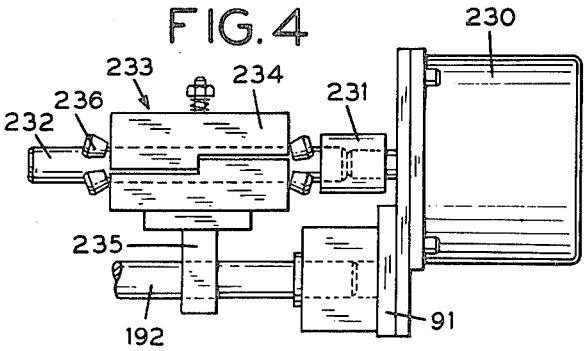

FIG.15
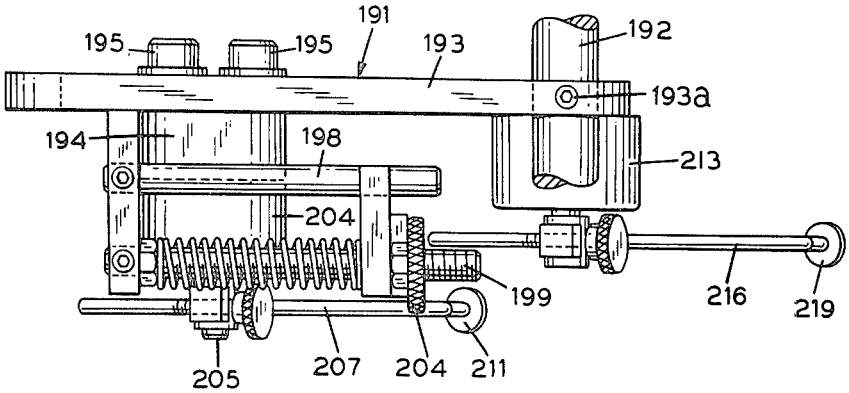
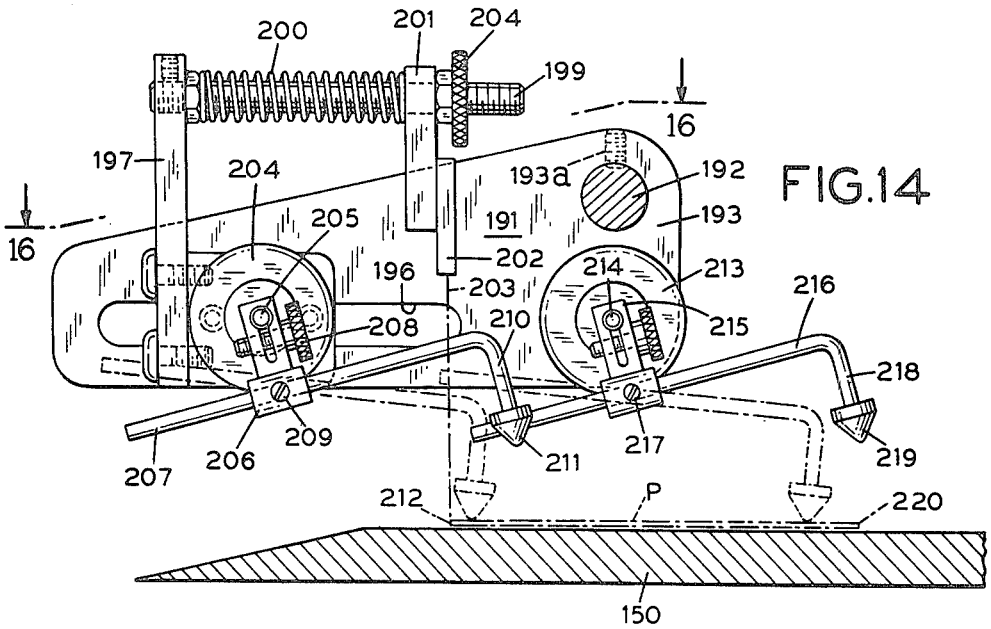
FIG.14
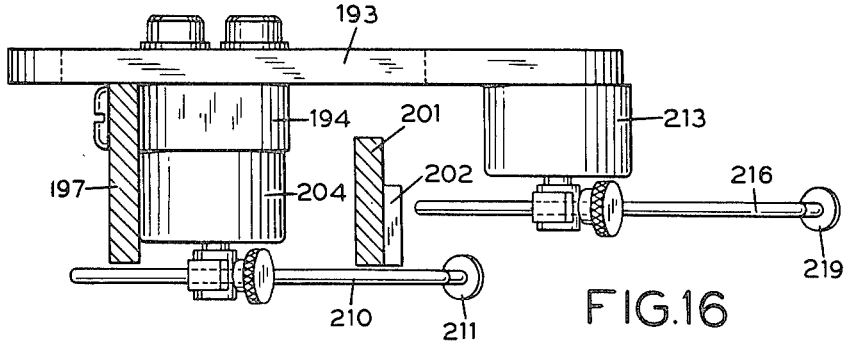
FIG.16

FIG.19
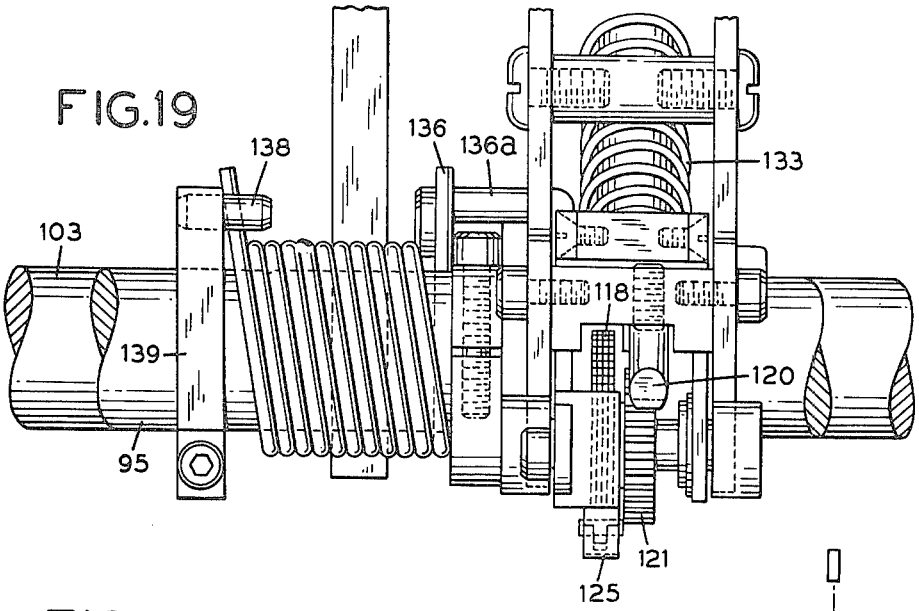
FIG.18
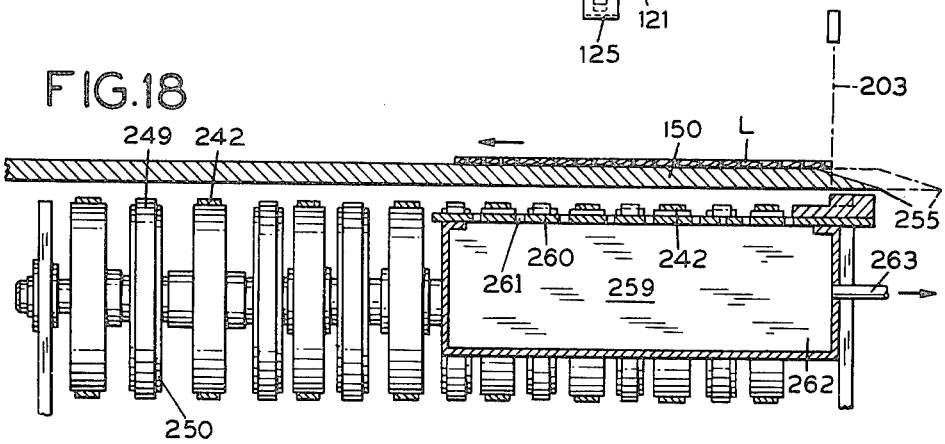
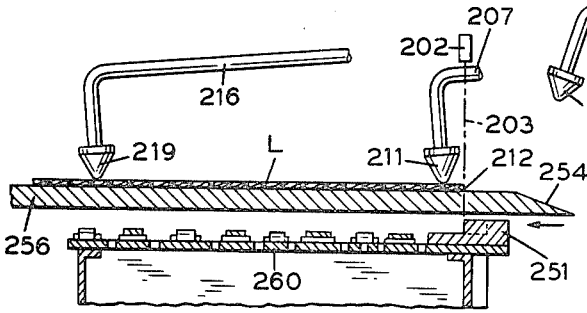
FIG.20
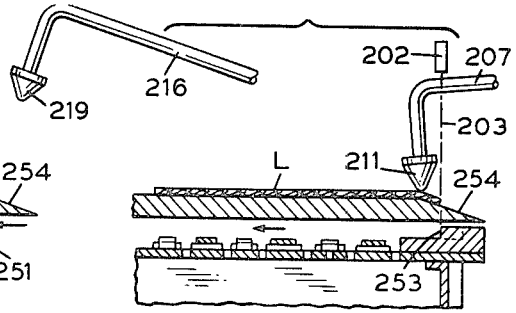
FIG.21
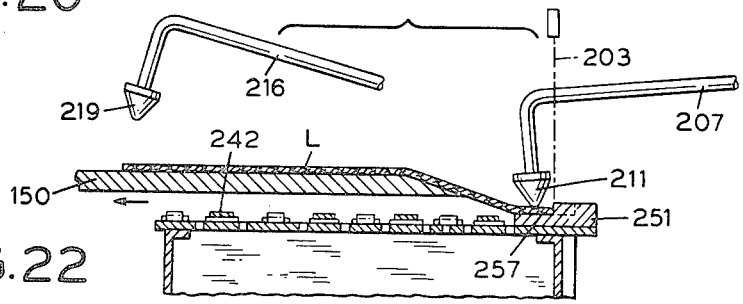
FIG.22

METHOD AND APPARATUS FOR HANDLING, POSITIONING AND ASSEMBLING FABRIC PLIES

This is a division of application Ser. No. 689,995, filed May 26, 1976.

RELATED APPLICATIONS

This application is related to the application of Kenneth O. Morton, Ser. No. 471,029, filed May 17, 1974, now U.S. Pat. No. 3,940,125, owned by the assignee of this invention. The before-mentioned Morton patent relates to method and apparatus for picking and transporting limp plies, and the subject matter of that patent is useful to great advantage in connection with the subject matter of the present application, although not necessarily essential thereto.

BACKGROUND AND SUMMARY OF THE INVENTION

In the manufacture of wearing apparel, for example, efforts are continually being made to introduce further automation into the manufacturing procedures, in order to miminize labor cost. One of the areas that has proven particularly difficult to automate effectively has been the handling of limp fabric between the initial cutting operation and the eventual sewing operation at another location. An important advance in this respect is reflected in the before-mentioned Morton U.S. Pat. No. 3,940,125, which provides a simplified yet highly effective mechanism for removing fabric plies one at a time from a stack of cut plies, for conveyance to a subsequent processing stage, such as a hemming operation. The inventions of the present application are related primarily to the handling and manipulation of the fabric plies subsequent to the removal thereof from the stack of cut plies.

In accordance with one aspect of the invention, a novel and advantageous arrangement is provided for delivering fabric plies one at a time to a load station and orienting the plies precisely at such load station, for a subsequent processing operation, such as hemming, or assembly with other plies of fabric. In this respect, the apparatus of the invention include a reciprocating shutter plate, which receives a fabric ply, removed from a stack thereof by an appropriate picking means, such as that of the Morton U.S. Pat. No. 3,940,125. The shutter plate, after thus receiving the fabric ply moves to the load station position, carrying the ply with it. Bearing in mind that the ply may be poorly oriented in the first instance, because of irregularities in the ply stack, and/or that the relatively rapid movement of the shutter plate in transferring the ply to the load position may slightly disturb the ply, novel provisions are made for effecting precise alignment and orientation of the ply at the load station position, before advancing the ply to a further production operation. Pursuant to the invention, the leading edge of the fabric ply, resting on the advancing shutter plate, is detected independently at widely spaced points by spaced photocell detectors, which are positioned to intercept the leading edge of the fabric ply. Operating in conjunction with these photocell sensors are individual ply retaining and hold-down elements, which respond instantly to interruptions of the photocell, to retain the ply in its then position. This action occurs while the shutter plate is still in motion and, if the fabric ply is approaching the load station in a skewed condition, one of the sensors will be actuated prior to the other, so that one side of the fabric ply is restrained, while the other is free to continue moving with the shutter plate. This causes the ply to swing around into a proper orientation, at which time the second photocell sensor is operated, and the fabric ply is restrained at two points and thereafter held in a precise, desired orientation.

In some cases, it is necessary or desirable to align the fabric ply edgewise. In such cases, provision is made for bodily shifting the fabric ply in a lateral direction, after orientation and restraint of the fabric ply with reference to its front edge. The mechanisms provided for this purpose are simple, yet remarkably effective.

In a typical production operation, fabric plies of various kinds and weights must be handled successfully if the system is to be universally applicable. Inasmuch as many of the fabric plies to be handled may be very limp and flimsy in nature, the orienting system of the invention includes provisions for sensing the leading edge of the ply but restraining the ply from a point near its trailing edge. This avoids buckling or wrinkling of a limp ply after the ply is restrained but while the shutter plate, on which the ply is supported, continues to move toward the load position.

According to one aspect of the invention, removal of the aligned and oriented ply, after delivery to the load station, is effected by restraining the ply and then withdrawing the shutter plate. For this purpose, the invention contemplates the utilization of a second set of ply restraining elements, engageable with the oriented fabric ply near its leading edge area, and operative to retain the ply in position as the shutter plate is retracted away from the load station. Thus, during the orienting phase, when the shutter plate is moving toward the load station, the fabric ply is engaged near its trailing edge, while during the unloading phase, when the shutter plate is retracting away from the load station, the fabric ply is engaged near its original leading edge (which is now the trailing edge in relation to the shutter plate motion). The arrangement is such that, under either condition, the motion of the shutter plate under the restrained fabric ply tends to maintain the ply in a flat condition.

In one particularly advantageous form of the invention, the system is utilized for the assembly of the components of a lined shirt sleeve cuff. In such case, provision is made for supporting separate stacks of liner plies and cuff plies in side by side relation. During each cycle of the mechanism, one liner ply and one cuff ply are removed from their respective stacks by the picking head apparatus and deposited side by side on a single, common reciprocating shutter plate. The shutter plate is then advanced toward the load station and, upon reaching the load station, the individual liner and cuff plies are properly oriented on the shutter plate. The shutter plate is then withdrawn, while the previously aligned plies are retained, thus causing the respective plies to be deposited side by side at the load station. In the contemplated arrangement, the load station includes a transversely movable index conveyor, which is arranged to convey a deposited liner ply over into a position underneath the deposit position for a cuff ply. In a normal sequence of operation, a liner ply from one cycle of operation is brought into position to receive on top of it a cuff ply from the next subsequent cycle of operations. The assembled plies can then be transported by the index conveyor to a subsequent processing sequence including folding and hemming.

Where the apparatus of the invention is to be used for the assembly of components of a lined cuff, the individual components are arranged in separate supply stacks, each with an independently operated stack elevator means arranged to maintain the stacks at the right height for the picking apparatus. In an alternative mode of operation, the equipment may be utilized for the handling of single, large ply, such as an entire sleeve for a short sleeve shirt. In such cases, the ply stack may span both of two independently operated elevator platforms. These platforms, while operated independently, serve to keep adjacent portions of the supply stack at a common level, for proper engagement by a plurality of picking heads.

It will be understood, of course, that the foregoing are merely broadly illustrative of the potential uses for the method and apparatus aspects of the invention. For a more complete understanding of the invention and its many features and advantages, reference should be made to the following detailed description of a preferred embodiment and to the accompanying drawings.

DESCRIPTION OF THE DRAWINGS

FIG. 3 is a top plan view of the apparatus of FIG. 1.

FIGS. 4–6 are fragmentary cross sectional views as taken generally on lines 4—4, 5—5 and 6—6 respectively of FIG. 3.

FIG. 14 is a fragmentary cross sectional view as taken generally on line 14—14 of FIG. 3, illustrating a ply orienting mechanism according to the invention.

FIG. 15 is a top plan view of the ply orienting mechanism of FIG. 14.

FIG. 16 is a cross sectional view as taken on line 16—16 of FIG. 14.

FIG. 18 is a fragmentary cross sectional view as taken generally on line 18—18 of FIG. 17.

FIG. 19 is a fragmentary back elevational view of the picking unit of FIGS. 8, 9.

FIGS. 20–22 are sequential schematic views illustrating the principles of operation of the ply orienting mechanism of FIG. 14.

DESCRIPTION OF A PREFERRED EMBODIMENT OF THE INVENTION

Figure 1:
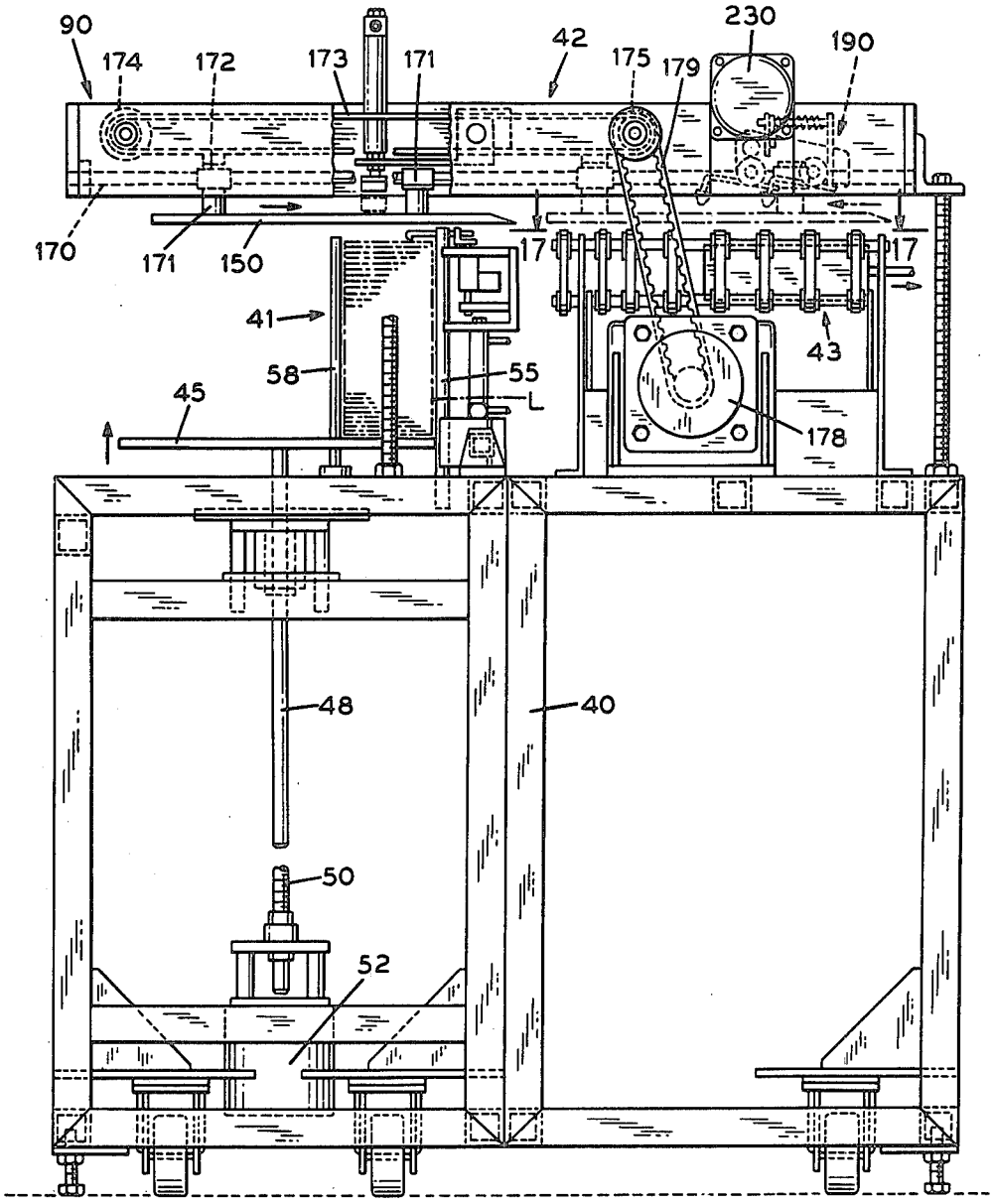
FIG. 1 is a side elevational view of an apparatus according to the invention, as set up specifically for the assembly of shirt cuff components in advance of a hemming operation.
Figure 2:
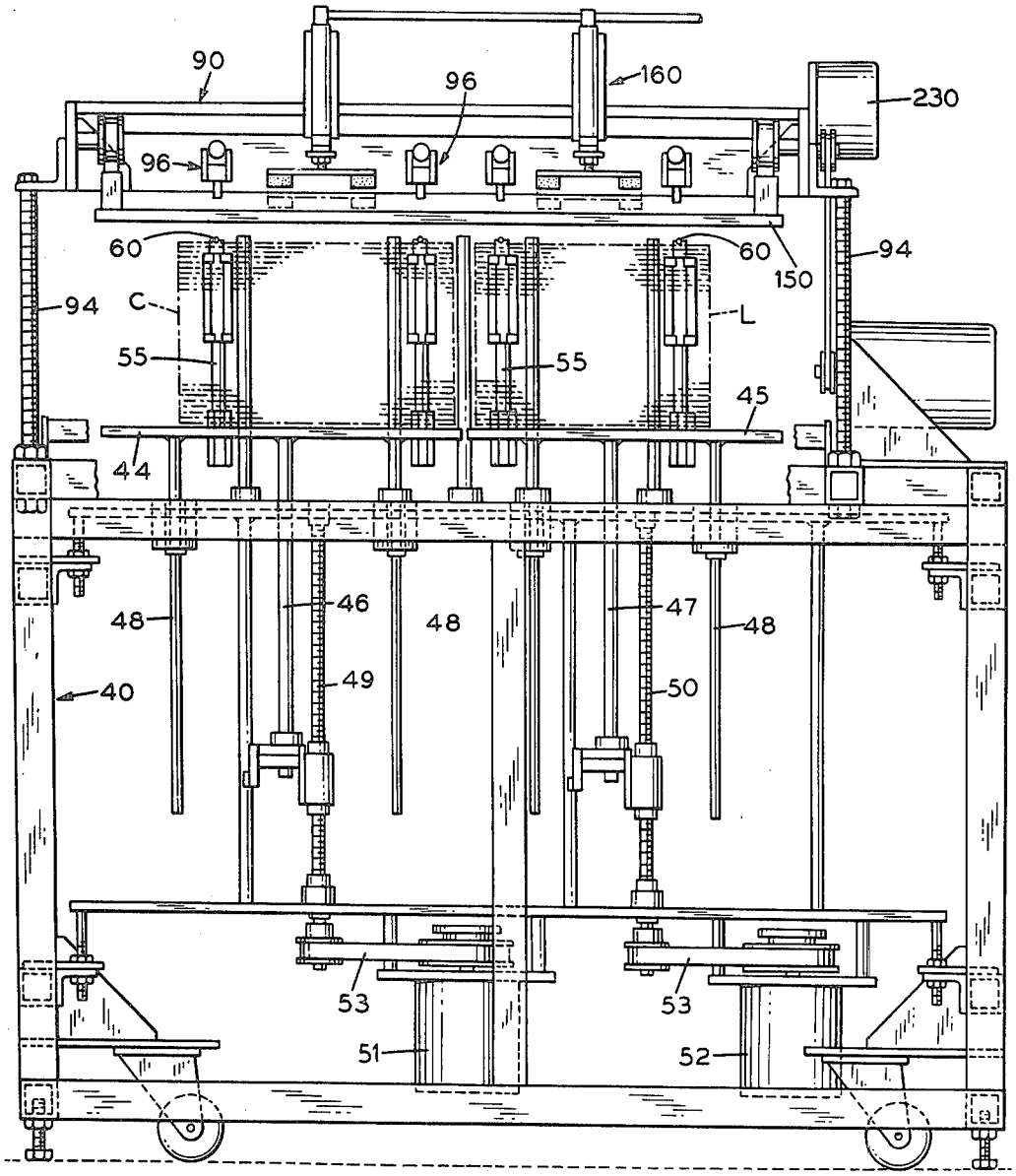
FIG. 2 is a back elevation of the apparatus of FIG. 1.

Referring now to the drawings, and initially to FIGS. 1–3 thereof, the illustrated form of equipment includes a main frame structure 40, which is arranged to mount a fabric supply section 41, a transport section 42 and a conveyor section 43. In general terms, fabric plies are arranged in a stack or stacks in the supply section, are picked off the stacks one at a time and carried by the transport section 42 over to the conveyor section 43. After orienting, alignment and, where desired, assembling with other components, the transported plies are conveyed away by the conveyor section 43 for subsequent processing, as in a hemming operation. The specific form of the subsequent processing equipment is not germane to the present disclosure, and is not illustrated or described herein.

Fabric Supply Section

The fabric supply section includes a pair of elevator platforms 44, 45, which are mounted on supporting rods 46, 47 and stabilized by slideable guide rods 48. The supporting rods 46, 47 are engaged with threaded shafts 49, 50 respectively, which are arranged to be controllably rotated by motors 51, 52, through belts 53.

The elevator platforms 44, 45 are arranged and intended to support individual stacks of fabric plies of various sizes and shapes. In the specific illustration of FIGS. 1–3, ply stacks are indicated as typical for shirt cuff assemblies, including an outer cuff ply C and a liner L. Inasmuch as the size and shape of the ply stacks will vary, provision is made for adjustable confinement of ply stacks of various configurations. To this end, one or more vertical guide bars 54 are positioned between the elevator platforms 44, 45 and are arranged to extend upward along the end faces of the respective stacks of plies C and L.

Along the front edges of the respective platforms are spaced pairs of normally fixed guide bars 55, typically arranged one pair in association with each of the elevator platforms. As reflected in FIG. 6, the front guide bars 55 are carried by mounting brackets 56 which are clamped to transverse frame members 57 to accommodate lateral adjustment. A pair of rear guide bars 58 is associated with each platform to confine the back edges of the ply stack. The guide bars 58 are mounted on the frame structure 40 for forward and rearward adjustment. The platforms 44, 45 are provided with longitudinally elongated slots 59, enabling the back guide bars to project upward through the platforms in any adjusted position. As will be apparent in FIG. 3, the forward guide bars 55 and the central guide bars 54 provides fixed reference surfaces for the inside edges and the front edges of the fabric ply stacks C, L. The back guide bars 58 are adjusted, according to the size of the plies, to confine the back edge of the stack. Generally, it is not necessary to confine the outer edges of the ply stacks, although additional guide bars could be provided for that purpose if desired.

For purposes to be described in greater detail, each of the forward guide bars 55, serves to mount a stack sensing and hold-down finger 60 (see FIGS. 6, 7) which extends rearward from its mounting bracket 61 and has a downwardly extending projection 62 arranged to engage the top ply of the stack C at a point spaced somewhat inward from the forward edge 63 of the stack. The hold-down function of the finger 60 will be described hereinafter with respect to the ply transport functions. In addition to its hold-down functions, however, the finger 60 serves to sense the level of the top ply 64 of the stack, causing the appropriate platform motor 51 or 52 to be energized for incremental upward movement of the platform 44 or 45, in response to the ply stack level being lowered below a desired level.

Figure 7:
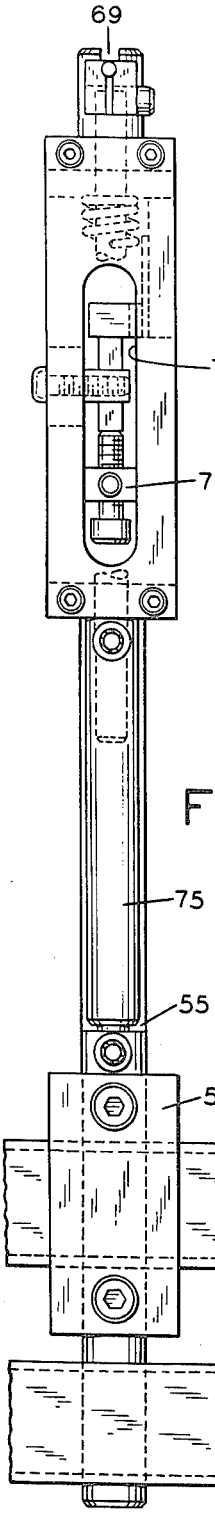
FIG. 7 is a front elevational view of the mechanism of FIG. 6.
Figure 6:
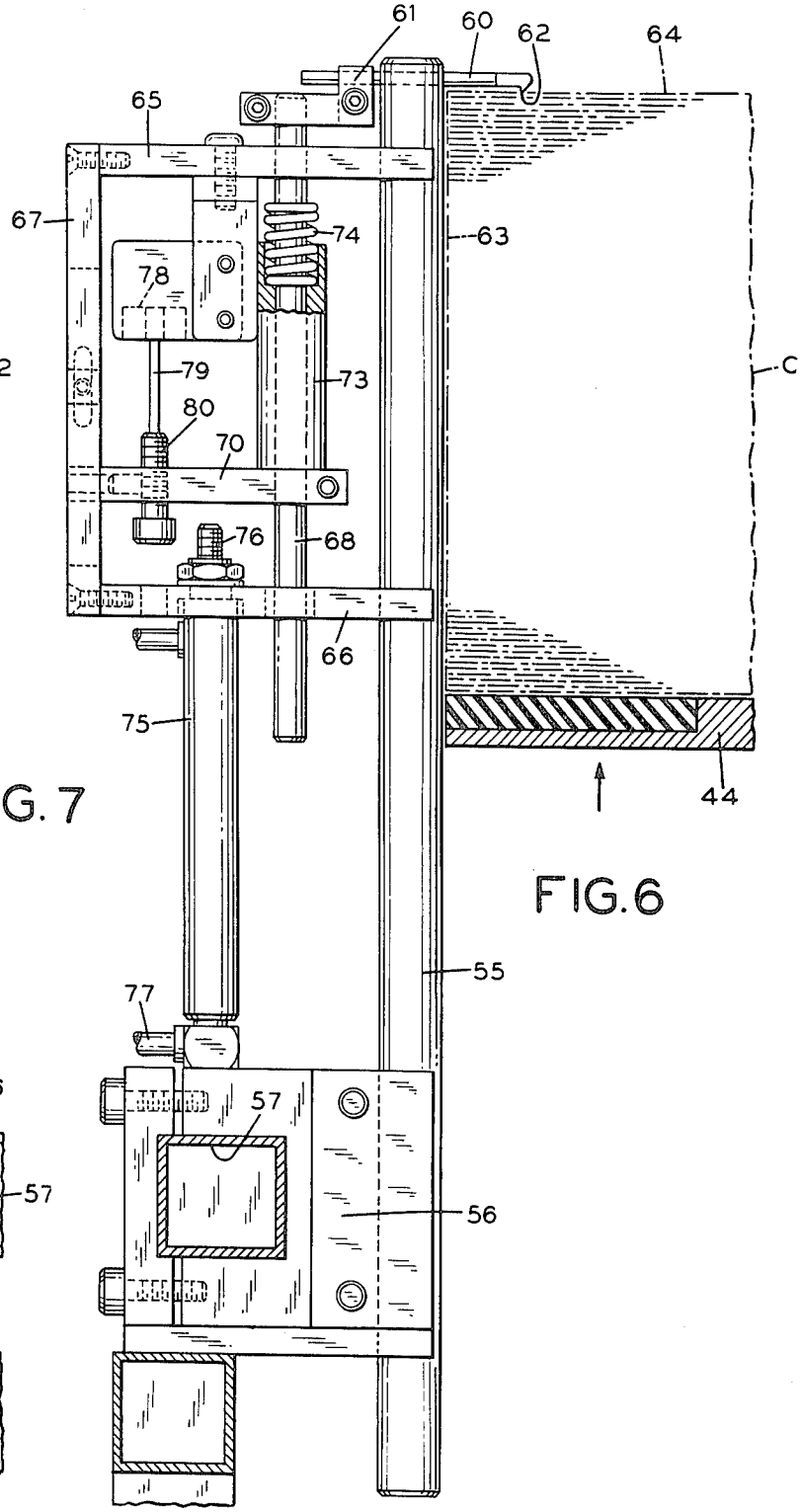

With reference particularly to FIGS. 6 and 7, a guide frame, comprising upper and lower clamping bars 65, 66 and a vertical member 67, is secured to the front guide bars 55. A rod 68 is slideably supported in the spaced clamping bars 65, 66 for limited vertical movement and carries at its upper end the bracket 61 securing the hold-down finger. Desirably, the front guide bar 55 is slotted at 69 to receive the hold-down finger 60 and accommodate limited vertical movement thereof.

Secured to the slideable rod 68 is a guide bar 70, which is provided at its forward end with a tongue 71 slideably received in a vertical slot 72 in the frame bar 67. A sleeve 73 is supported by the guide member 70 and carries a compressible spring 74 at its upper end.

Secured to the lower clamping bar 66 is an air cylinder 75, the rod end 76 of which underlies the guide bar 70 and is arranged to engage and lift the guide bar when the cylinder 75 is actuated to extend. As will be further desribed, during each cycle of operations, when a ply of fabric is removed from the ply stack, the rod 68 and hold-down finger are momentarily lifted by actuation of the cylinder 75. Thus, air is introduced into the lower end of the cylinder, through a conduit 77, driving the rod 76 upward into engagement with the guide bar 70 and thereafter lifting the guide bar 70, the rod 68 and the hold-down finger 60 upward compressing the spring 74 until stopped by sleeve 73. When air is later released from the cylinder 75, and it is retracted, the spring 74 accelerates the movement of the rod 68 and hold-down finger downward, until the finger 60 contacts the top of the ply stack.

To sense the height of the ply stack, a sensing device 78, which may be in the form of a photo transistor sensor, is arranged to cooperate with an actuator element 79 extending from an adjusting screw 80 carried by the guide bar 70. As successive plies are removed from the stack, the hold-down finger 60, and therefore the actuator element 79 will fall back to successively lower levels. When the beam of the photo transistor sensor 78 is uninterrupted, the elevator platform motors 51 or 52 will be actuated through appropriate control circuitry (not shown) to raise the platform to a predetermined height. This enables the height of upper layer of the ply stack to be maintained at all times within a predetermined, limited range. Generally, although each of the front guide bars 55 is provided with a hold-down finger assembly as described, typically only one assembly of each pair needs to be provided with a stack level sensor 78, 79. Nevertheless, it may be appropriate to provide each unit with a stack level sensor, to facilitate some of the alternative uses of the equipment, to be hereinafter described.

Transport Section

The ply transport section of the illustrated apparatus includes means for picking plies one at a time from the respective stacks, depositing the plies on a transport shutter or platen, and moving the platen to the conveyor section. The means for picking the individual plies from the ply stacks are constructed in substantial accordance of the teachings of the previously mentioned Morton U.S. Pat. No. 3,940,125, and are illustrated particularly in FIGS. 8–13 hereof.

In general, the transport section of the illustrated apparatus includes a structural frame 90 comprising spaced side rails 91, 92 and a forward end rail 93 (see FIG. 3). The transport frame 90 is mounted on the main frame structure 40 by means such as a plurality of support posts 94. A picker head mounting rod 95 is supported in the side rails 91, 92 and extends transversely of the apparatus adjacent the forward edges of the ply stack platforms 44, 45. The picker head shaft mounts for pivotal movement a plurality of picker assemblies 96 (see FIGS. 8, 9) of the general type disclosed and claimed in the Morton patent. Pursuant to one aspect of this invention, the arrangement of such picker head assemblies 96 is such that two such picker head assemblies are provided for each of the fabric plies C, L. In this respect, it is generally contemplated that the uses for which the present apparatus is intended will involve the utilization of a plurality (typically two) of picker head assemblies to effect extraction of a ply from a ply stack. However, while certain aspects of the invention are directed to the utilization of multiple picker head assemblies, other features of the invention are not limited thereto, as will appear.

Figure 9:
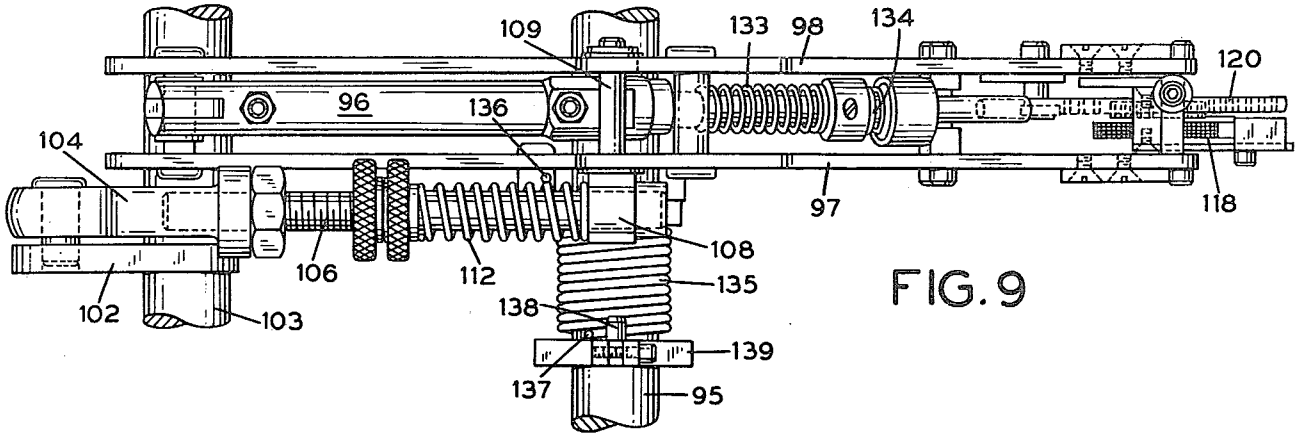
FIG. 9 is a top plan view of the picking unit of FIG. 8.
Figure 8:
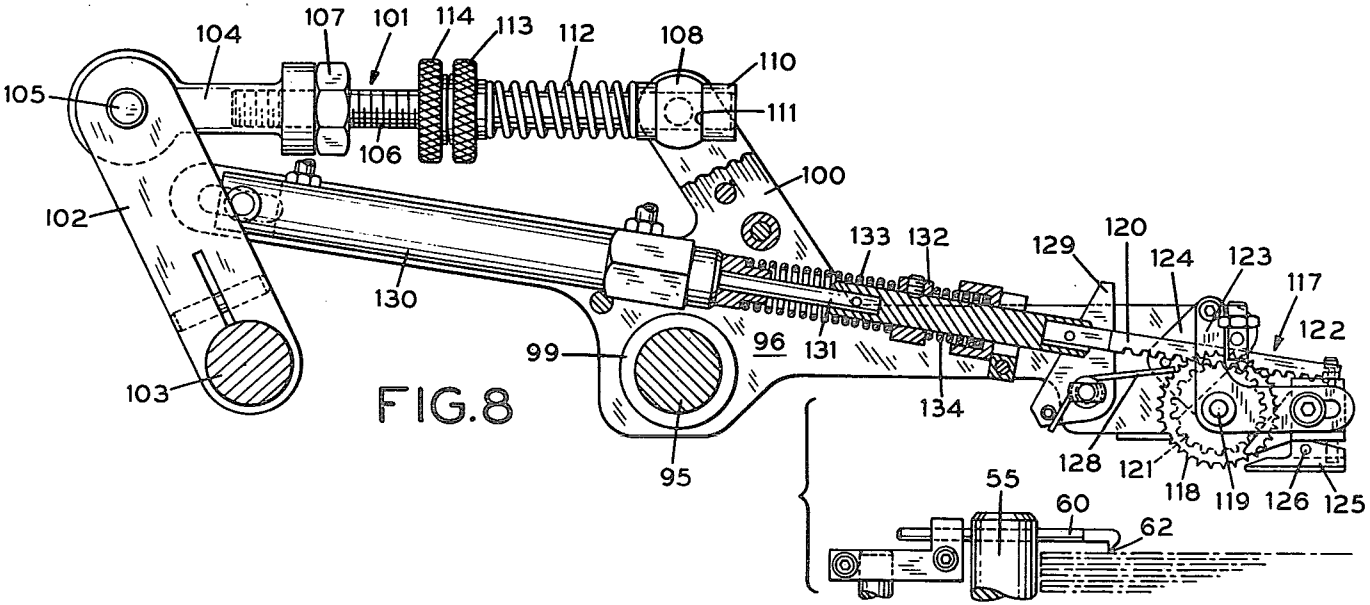
FIG. 8 is a fragmentary cross sectional view as taken generally on line 8—8 of FIG. 3, illustrating details of a picking head mechanism.

As reflected particularly in FIGS. 8 and 9, the picker head assemblies include a pair of spaced, connected-together picker arms 97, 98, rotably mounted by means of a bearing 99 on the picker shaft 95. Lever arms 100 extend upward from the picker arms and are connected through connecting rod assemblies 101 to rocker arms 102 secured to a common rock shaft 103. A single rock shaft 103 is arranged for controlling all of a plurality of picker head assemblies 96 for simultaneous actuation.

In the illustrated form of the invention, the connecting rod assemblies 101 comprise a link 104 pivotally connected at 105 to a rocker arm 102 and threadedly connected to a rod 106. The rod 106 is threadedly received in the link 104 and is arranged to be secured in a pre-adjusted position therein by means of a lock nut 107. The rod 106 is slideably received in a slide bearing 108, which in turn is pivotally connected to the lever arms 100 by means of a pivot pin 109. A collar 110 is fixed to the outer end of the rod 106 and is urged against the outer face 111 of the slide bearing 108 by means of a compressible coil spring 112 maintained in a desired pre-compression by means of adjustable nuts 113, 114 engaging a threaded portion of the connecting rod 106.

In operation of the equipment, when it is desired to actuate the picker assemblies, the rock shaft 103 is rotated in clockwise direction, as viewed in FIG. 8, this being accomplished by actuation of an air cylinder 115 (see FIG. 3) anchored at one end to the frame rail 92 and at its other end to a crank arm 116 secured to the rock shaft 103. When the rock shaft rotates clockwise, as viewed in FIG. 8, connecting rods 106 drive the lever arms 100, pivoting the several picker assemblies 96 clockwise about the common picker shafts 95. As the individual picker heads 117 contact and are resisted by the material of the ply stacks, further rotation of the picker assemblies 96 is resisted while continued movement of the connecting rod assemblies 101 is taken up by compression in the springs 112 and sliding of the rod 106 through the slide bearings 108. As will be appreciated, although all of the several picker head assemblies are actuated in unison through the rock shaft 103. The operation of the individual picker heads will be a function of the character of the ply stack directly underneath, the level of the ply stacks, and of the pre-adjustment in the individual springs 112. In this respect, the separate stacks of plies C, L may be at slightly different heights at any given time. Moreover, within the same ply stacks, there may be height variations from one area to another, resulting from irregularities in the stack and/or variations in the character of the fabric itself as with certain striped or patterned materials, for example.

As described in the Morton U.S. Pat. No. 3,940,125, each picker assembly includes a picker head mechanism 117 comprising a toothed wheel assembly 118 journaled for rotation on a shaft 119 and rotable by a rack and pinion assembly 120, 121. When the picker assembly is lowered by operation of the rocker arm 103, the wheel is pressed downward against the fabric stack with a force proportional to the adjusted pre-compression adjustment of the spring 112, as will be understood.

Figures 10, 11:
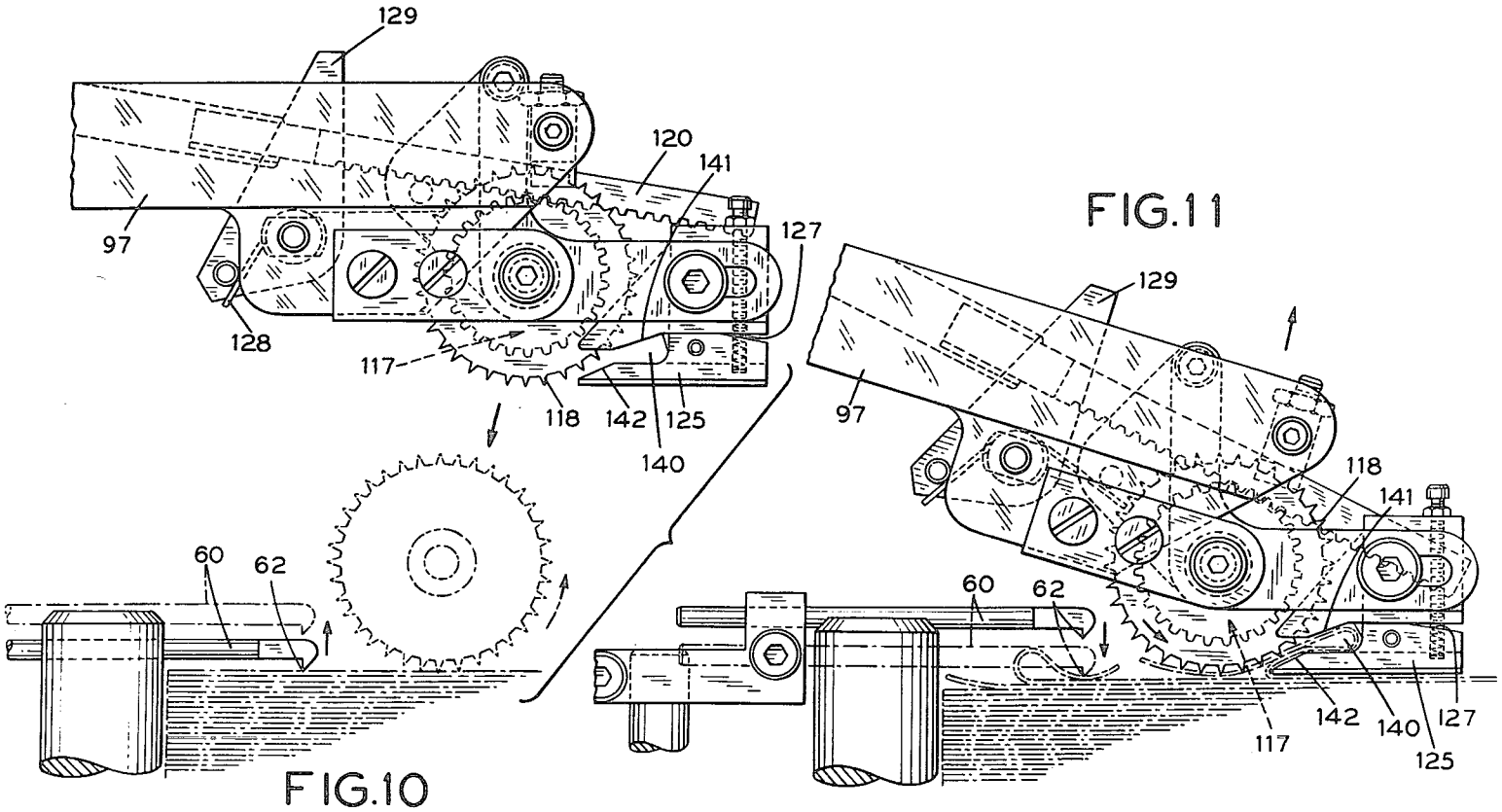
FIGS. 10–13 are fragmentary sequential views illustrating the manner of operation of the picking unit of FIGS. 8 and 9.
Figure 13:
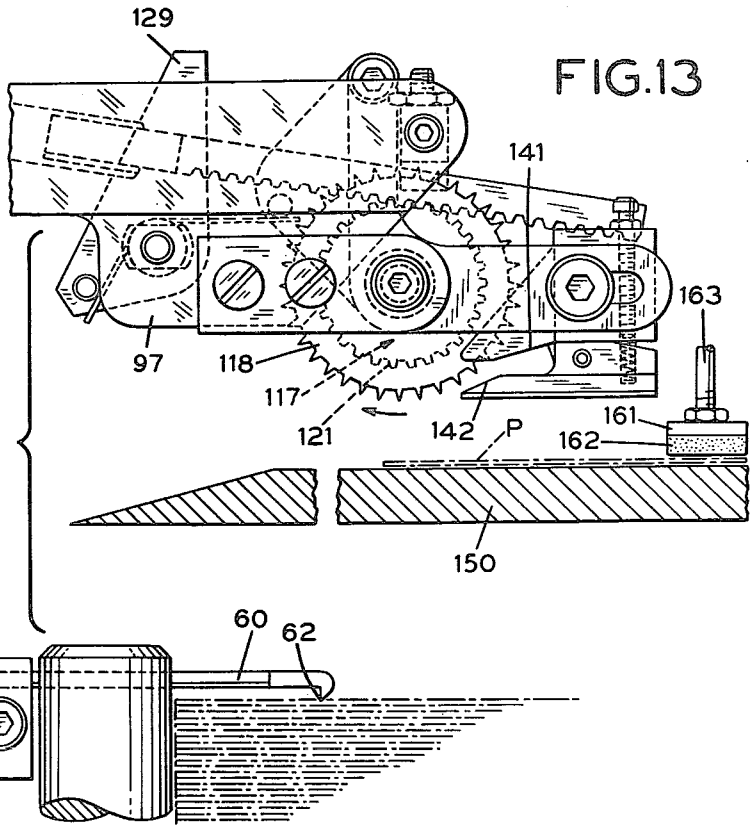
Figure 12:
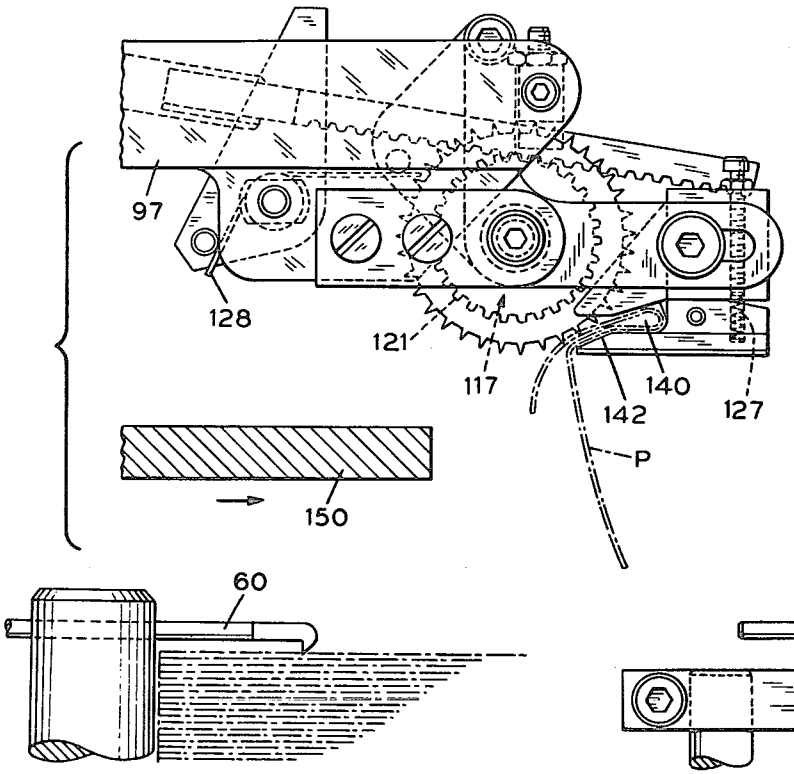
Figure 17:
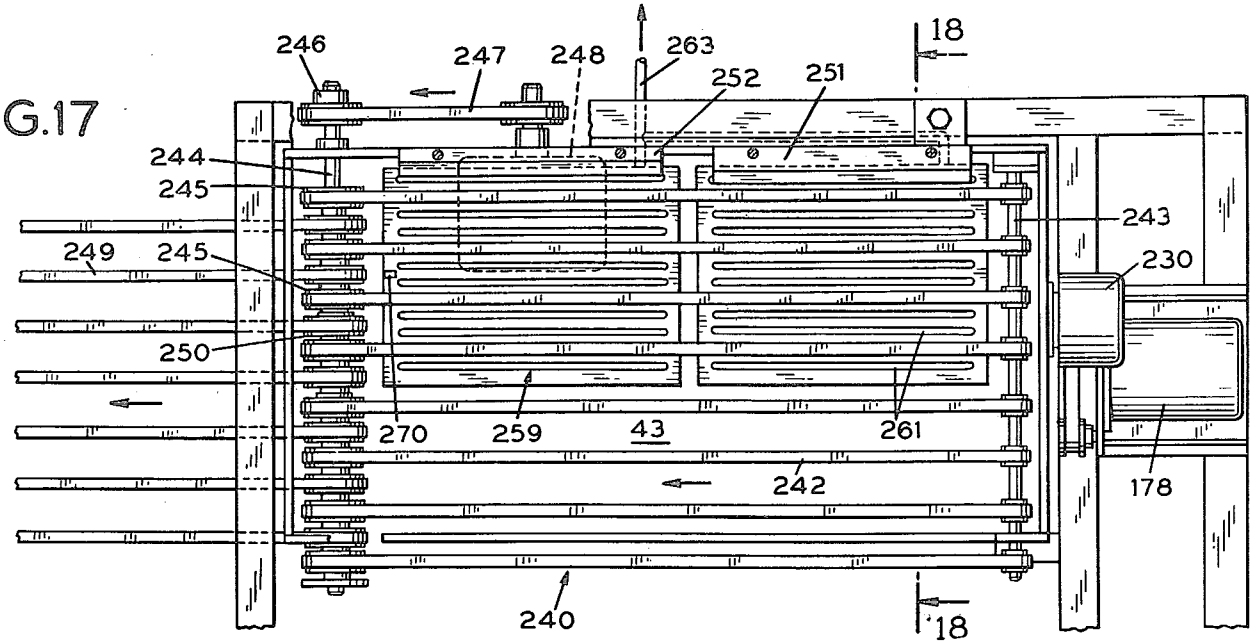
FIG. 17 is a cross sectional view as taken generally on line 17—17 of FIG. 1.

In addition to the picker wheel assembly 118, the picker head assembly includes a shoe assembly 112 carried by levers 123, 124 pivoted on the wheel shaft 119. The shoe assembly includes a presser foot 125, which is pivoted at 126, being urged to pivot clockwise by a spring 127 (FIGS. 10, 11). The enire shoe assembly 122 is urged to pivot counterclockwise by a torsion spring 128 the effective force of which is adjustable by a lever 129.

Limited, controlled rotation of the toothed wheel assembly 118 is effected by a double acting air cylinder 130, the rod 131 of which is connected to the rack 120. The rod 131 is normally held in an intermediate position, by means of a collar 132 and pre-compressed springs 133, 134. The arrangement is such that, when the cylinder 130 is actuated to retract, the toothed wheel assembly is rotated counterclockwise through a perdetermined arc of rotation, until the cylinder rod bottoms (or engages a stop). When the actuation of the cylinder is reversed, extending the rod, it moves through its neutral or rest position and extends further, such that the rotation in the clockwise direction is somewhat greater than the rotation in the counterclockwise direction, providing reliable fabric castoff. When both ends of the cylinder are exhausted, the rod returns to its neutral position, where the springs 133, 134 are balanced, such neutral position being a function of the adjusted position of the collar 132.

Each of the picker assemblies 96 is designed to be approximately balanced about the axis of the shaft 95 to nullify the weight of the picking head on the stack. Since, in a practical way, this is difficult to achieve with precision, an individual balance adjustment is provided for each picker unit, in the form of a torsion spring 135 (FIG. 19), one end 136 of which engages a lug **136*a* extending from one side of the picker assembly 96 and the other end 137 of which engages a lug 138 provided on a collar 139 adjustably secured to the picker shaft 95. The torsion spring 135 exerts a limited counterclockwise rotational force on the picker assembly, to balance a slight normal bias to rotate clockwise. An ideal balance can be achieved by rotational adjustment of the collar 139, such that the pressures applied by the picker head unit 117 to the fabric plies are not affected by unbalanced weight and can be precisely controlled by the pre-adjustment of the springs 112**. The use of a torsion spring balance means is greatly superior to means such as a counterbalance weight, for example, which would add undesirable rotational mass to the assembly, reducing speed and/or introducing an undesirably degree of bounce of the picking head on the ply stack.

With reference to FIGS. 9–13, a typical cycle of operation of the picker unit 96 involves actuation of the rocker arm 103 to lower simultaneously all of the picker heads. The toothed wheel assemblies will engage the upper plies and press upon them with a force determined by the preadjustment of the spring 112. The presser foot 125 will be pressed against the adjacent surface of the ply as a function of the torque imposed by the spring 128. In this respect, it will be noted that the several picker units, although actuated in unison by a single actuator 115, will act with independent, individually controlled effect upon the ply stacks. because each unit is separately adjustable with respect to its balance spring 135, wheel pressure spring 112 and foot pressure spring 128.

When the picker units are lowered, the hold-down finger 60 associated with each unit will have been lifted by actuation of its cylinder 75. The picker cylinder 130 is now actuated to retract, rotating the toothed wheel assembly 118 in a counterclockwise direction and causing the upper ply to be buckled into a wave and the wave driven into an accumulation cavity 140. In this respect, the ply is stripped off of the wheel 118 by means of a stripper element 141 forming the upper portion of the accumulation cavity and having a portion which extends alongside the toothed wheel assembly, within its peripheral outlines.

As the picker wheel 118 rotates through a predetermined arc, with the presser foot 125 holding stationary the adjacent area of the upper ply, a predetermined wave of fabric is driven into the accumulation cavity, and the fabric is pinched or nipped between the wheel and a gripping surface 142 on the pivoted presser foot. At this stage, the hold-down finger 60 is permitted to drop to its normal position, engaging and retaining the second ply. Desirably, the hold-down finger engages the ply primarily at a localized point 62. As explained in the before-mentioned Morton patent, the location of the limited point 62 is at a distance from the forward edge of the ply stack less than the linear displacement of the upper ply, caused by rotation of the wheel 118, but greater than one half of that distance. This enables the hold-down finger 60 to engage the second ply, even in cases where the second ply may be dragged along with the first as a result of end edge entanglement. In a practical form of the mechanism, the pressure point 62 may be of relatively small downward projection (e.g., 0.020 of an inch or so) but should be sufficiently well defined to reliably restrain a connected second ply from being taken away with the gripped upper ply.

After nipping of the upper fabric ply, as shown in FIG. 11, and lowering of the hold-down finger 60, the picker assembly 96 is raised by reverse rotation of the rocker shaft 103. This raises the forward edge of the ply, in the manner shown in FIG. 12, breaking it away from any edge entanglement with the second ply, held by the hold-down finger 60. In this respect, although the hold-down fingers are shown in FIG. 3 to be offset from the respective picker assemblies, for clarity of illustration, in actual operation it is intended that the hold-down finger assemblies be substantially aligned in the longitudinal direction with the respective picker assemblies, so that the holding action or restraint of the hold-down elements is directly opposed to the lifting force of the associated picker head.

As soon as the forward edge of the ply has been lifted by the picker head or heads, a shutter plate, to be described further, is advanced in a rearward direction and interposed between the picker head assemblies and the ply stack. While the lifted ply P remains gripped by the picker head, the shutter plate 150 moves to its rearward limit position, completely separating the ply from the stack and causing the ply to rest on the upper surface of the shutter. At that point, the picker cylinder 130 is reversed, rotating the toothed wheel assembly 118 clockwise through a somewhat greater arc of rotation than during the pickup operation, to effect reliable castoff of the fabric and cause it to be deposited on the surface of the shutter 150.

Because the fabric plies may be of relatively light material, and of relatively broad expanse, it takes a finite time for the castoff portions of the fabric to fall by gravity onto the shutter plate 150. If the forward or transport motion of the shutter is commenced too soon, friction between the ply and the shutter may be insufficient and movement of the fabric ply P along with the shutter may tend to be irregular. To minimize the extent of any necessary delay period between castoff of the ply and forward motion of the shutter plate 150, the transport section may include presser assemblies 160 associated with the picking assemblies. As reflected particularly in FIGS. 3 and 5, the presser assemblies include a transversely disposed presser bar 161 having resilient pads 162 at each end. The presser bar 161 is mounted on the rod of an air actuator 163, which may either be double acting or single acting (down) and spring returned. The presser cylinders 163 are mounted on brackets 164 secured to a transverse rod 165 carried by the frame rails 91, 92. The arrangement is such that the presser cylinders 160 may be adjusted transversely on the bar 165 and longitudinally on the brackets 164 for optimum positioning relative to the respective sets of picking units.

Simultaneously or substantially simultaneously with the castoff motion of the picking units, the presser cylinders 160 are actuated momentarily to sharply drive downward the presser pads 162. These serve momentarily to press the ply P against the upper surface of the shutter plate 150, the experience has shown that this is generally adequate to establish sufficient friction between the plate surface and the castoff fabric ply to enable the ply to be carried away by the shutter without excess slippage of the ply.

In a typical arrangement of apparatus according to the invention, the fabric plies C, L may be of substantial width. In which case typically at least two picking units will be utilized for picking individual plies from the ply stack. In such cases, the presser assemblies 160 may be located between each pair of picking units.

Pursuant to one of the significant aspects of the invention, a pair of fabric plies, C, L, picked from adjacent supply stacks by respective pairs of picking units 96, are deposited on the transport shutter 150, which is then advanced in a forward direction to carry the plies to the conveyor section 43 of the equipment. By techniques to be described, the plies are manipulated while on the transport shutter 150 to effect precise orientation and positioning of the plies. While the plies are held in their thus oriented and aligned positions, the transport shutter 150 is withdrawn, effecting deposit of the plies onto an index conveyor. By properly timed and controlled movements of the conveyor it is possible to effect precise assembly of a cuff ply C on top of a liner ply L on the index conveyor. The assembled parts may then be conveyed away for hemming or other processing.

As relected particularly in FIGS. 1–3, the transport shutter 150 may be in the form of a flat plate, of generally rectangular configuration. The dimensions of the shutter are such as to easily accommodate fabric plies of the largest size contemplated to be processed by the apparatus. As shown particularly in FIG. 1, the transport frame 90 mounts a pair of spaced, longitudinally disposed guide rods 170 on which are received slide bearings 171 attached to the transport shutter 150. The guide rods 170 are of adequate length to accommodate forward and rearward longitudinal movement of the transport shutter between the forward, rearward limit positions indicated in FIG. 1. In the forward limit position, indicated in broken lines, the transport shutter overlies the index conveyor section 43, whereas in the retracted or rearward limit position, the transport shutter substantially overlies the elevator platforms 44, 45. The rearward slide bearings are secured to a pair of transport belts 173, trained about pulleys 174, 175. The forward pulleys 175 are mounted on a common shaft 176 journaled in the frame rails 91, 92. One end of the shaft 176 extends through the frame rail 91 and mounts a pulley 177 driven by a motor 178 (FIG. 1) by means of a timing belt 179.

Figure 30:
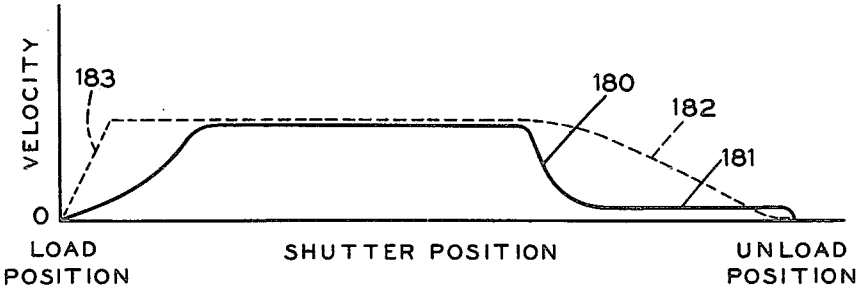
FIG. 30 is a simplified graphic representation of velocity versus position of a shutter platen which is utilized in the apparatus of the invention for the transporting of fabric plies from a supply position to a load station.

To advantage, the transport shutter drive motor 178 is a pulse-driven stepping motor, which is operated in accordance with a predetermined pulse sequence program for optimum average speed of travel. With reference to FIG. 30, for example, there is shown a typical graphic representation of shutter velocity versus shutter position, with the solid line representing the travel of the transport shutter in the feed direction (forward) and the broken line representing travel of the shutter in the retracting direction. Thus, after deposit on the shutter of the fabric plies, with the shutter in the load position, the shutter is accelerated, gradually at first and then at a somewhat increasing rate, to its maximum forward velocity. In a typical case, this maximum velocity may be on the order of twenty-four inches per second, although that is not to be considered limiting of the invention. After the transport shutter has traversed about two thirds of its stroke, it is rapidly decelerated, along a curve 180, to a minimum speed level reflected by the curve portion 181, which typically may be around six inches per second. The last twenty-five or so percent of shutter travel is at that low speed, and during that slow speed portion of the travel, the fabric plies are oriented in the manner to be described.

When reverse movement of the transport shutter 150 is commenced, the shutter is accelerated slowly as reflected by the curve portion 182, to its maximum speed, then driven at the maximum speed until close to the load position, and then rapidly decelerated along the curve portion 183 to zero speed at the load position. To advantage, the speed control of the transport shutter is effected by a pre-programmed sequence of timed pulses of the stepping motor 178. The particular program of pulsing the stepping motor is, specifically, not part of the present invention. However, for optimum utilization of the advantages of the invention, proper control of the acceleration and deceleration of the transport shutter by some appropriate means is highly desirable.

Orienting and Aligning Section

Pursuant to one of the significant features of the invention, fabric plies, after being picked one at a time from the ply stack and deposited on the transport shutter 150 are precisely oriented and aligned with respect to a fixed reference, before being deposited on the conveyor section. In this respect, a typical stack of fabric plies, having been handled numerous times subsequent to initial cutting, has a certain randomness to the individual plies, such that even under perfect conditions of picking and depositing on the shutter plate, the individual plies would have different orientation and alignment on the shutter plate. In addition to that, particularly where the system is operated at maximum practical speeds, it is possible for some slippage or buckling of the ply to occur, particularly during rapid acceleration and/or deceleration of the shutter plate. In the system of the present invention, a unique and novel arrangement is provided for precisely orienting and aligning the individual plies at the conveyor section of the system, so that all variations occurring prior to that stage are isolated and eliminated. As reflected particularly in FIGS. 1, 3, and 14–16, the apparatus of the invention includes an orienting section 190, including a pair of orienting stations 191 for each ply carried by the transport shutter 150. A supporting bar 192 is supported at each end in the frame rails 91, 92 and extends transversely across the apparatus, generally above the conveyor section 43. A plurality of the orienting stations 191 are mounted on the supporting bar 192, at adjustably spaced locations across its width, so as to be appropriately aligned with fabric plies brought into the orienting area by the transport shutter 150.

Referring now particularly to FIGS. 14–16, each of the orienting stations 191 includes a mounting plate 193 received over the supporting bar 192 and adjustably secured thereto by a set screw 193*a* or similar device. The mounting plate 193 extends forward from the bar 192 and carries a slide block 194 adjustably secured by bolts 195 in an elongated slot 196. The slide block 194 mounts a vertical extending support bracket 197 from which extend a guide rod 198 and an adjusting screw 199. A pre-compressed coil spring 200 is received on the adjusting screw 199 and bears rearwardly against a carrier bracket 201 mounting a photocell detector 202. The photocell detector 202 may be of a conventional, commercially available type, and is oriented to project a light beam 203 downward, to intercept the shutter plate 150, when the latter is in a forward position. The photocell detector 202 is arranged to receive reflected light from the surface of the shutter plate 150, which is of one characteristic when reflecting directly from the shutter surface, and which is of a different characteristic when reflected from the surface of the fabric ply P. Accordingly, during the forward movement of the shutter plate 150 carrying a just-picked and deposited ply, the photocell detector 202 will signal the arrival, at the vertical axis of the light beam 203, of the forward or leading edge 212 of the ply P.

Precise location of the light beam axis 203 is effected by primary and secondary adjusting capabilities. First, an approximate adjustment is provided by slideably positioning the mounting block 194 in the slotted opening 196. After thus approximately locating the block 194, the photocell sensor 202 may be adjusted with great precision by means of a thumb nut 204 mounted on the threaded rod 199. With the spring 200 acting on one side, and the thumb nut 204 on the other, the photocell mounting bracket 201 may be precisely advanced or retracted in the longitudinal direction, for effecting precision adjustment of the location of the light beam axis 203. The guide rod 198 engages an approximate slot or opening in the bracket 201, for slideably guiding the photocell bracket 201 during such adjusting movements, as will be understood.

Also secured to the slide block 194 is a first rotary acting solenoid device 204, having a rotary output shaft 205, to which is secured a mounting arm 206 carrying an L-shaped orienting finger 207. The arm 206 is adjustably clamped to the rotary output shaft 205, by means of a clamping screw 208, for adjustable rotary orientation of the arm, and the orienting finger 207 is in turn adjustably secured to the arm 206, by means such as a clamping screw 209. The orienting finger 207 includes a downwardly extending portion 210 mounting a conical resilient tip 211. As will be understood, the position of the conical orienting tip 211 with respect to the axis of the output shaft 205 may be varied by adjustably lengthening or shortening the orienting finger 207 in its mounting bracket 206. In general, the adjustment of the orienting finger 207 should be such that, when the ply P is properly aligned with its forward edge extremity substantially in line with the light beam 203, the conical tip 211 will engage the ply P adjacent to but behind its leading edge 212 (see FIG. 14).

At the forward end of the orienter mounting plate 193 there is a second rotary acting solenoid 213, which is mounted on the plate and has a rotary operating shaft 214 to which is adjustably secured a mounting arm 215. A second orienting finger 216, of generally L-shaped configuration, is adjustably secured to the mounting arm 215 by means such as a set screw 217. The orienting finger 216, like the finger 207, carries at the end of its downwardly extending arm 218 a conically shaped retaining tip 219, formed of resilient material. The second or rearward orienting finger 216 is adjustably positioned in its mounting bracket such that, when it is actuated to its lowered position (FIG. 14) it will contact the fabric ply P adjacent to but forward of its trailing edge 220. In this respect, it is contemplated that the optimum location of the leading edge of the ply, when properly oriented, will remain reasonably constant. However, the location of the trailing edge 220 will then be a function of the length dimension of the ply (longitudinally of the machine). Thus, it is contemplated that the rearward orienting finger 216 may have to be adjusted for each different size of fabric ply; moreover, a typical apparatus may desirably be provided with a plurality of sets of rear orienting fingers 216, in order to accommodate a wide range of sizes of fabric plies.

Figure 23:
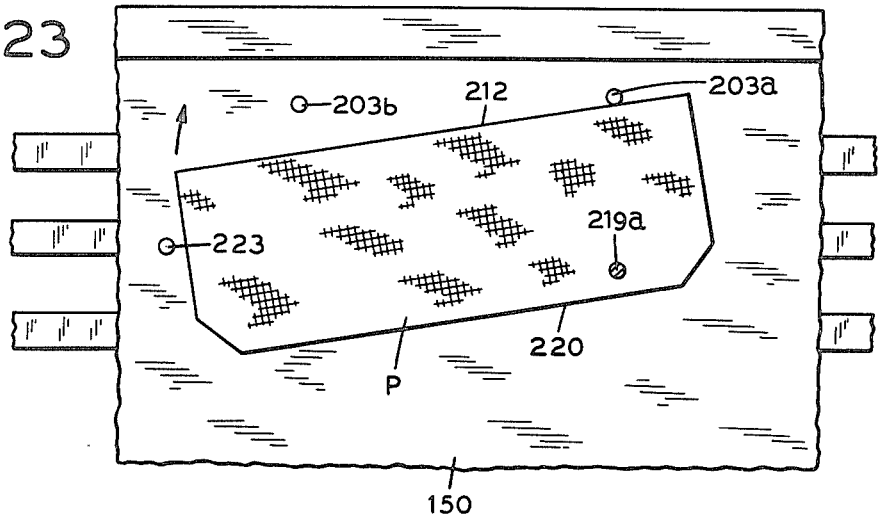
FIGS. 23–25 are sequential schematic views illustrating the procedure according to the invention for orienting and aligning a fabric ply in preparation for assembly with another ply.

As will be explained further in connection with a description of the operation of the system as a whole, the forward orienting fingers 207 are actuated at the time the transport shutter 150 approaches its forward limit position, carrying a fabric ply. For each ply, there are provided a pair of orienting assemblies 191, spaced relatively widely, so that the conical retainer tips 219 can engage the fabric ply at widely spaced points, advantageously near its side edge extremities. As reflected in FIGS. 23–25, when the transport shutter 150 is advancing to its forward position, carrying with it an unoriented ply, the leading edge 212 of the ply eventually will reach one of the light beams 203 from one of a pair of photocell scanners 202. Assuming the right hand side of the ply leads the left hand side, as shown in FIG. 23, the ply leading edge will first be intercepted by the right hand photocell beam 203*a*, changing the photocell output characteristic and causing immediate actuation of the rotary acting solenoid 213. This substantially instantly lowers the right side orienting finger 216 and its conical tip 219*a* into contact with the fabric ply, adjacent the trailing edge 220.

Pursuant to the invention, the position of original deposit of the fabric ply and the transport shutter 150, as effected by castoff from the picker units 96, is such that an unoriented ply will reliably be carried by the shutter at least up to the point where the leading edge 212 of the ply is intercepted by the photocell beams 203. Thus, in the condition of the apparatus indicated in FIG. 23, the transport shutter 150 is well back of its forward limit position at the time that the right hand photocell beam 203*a* is interrupted. At this moment, the fabric ply becomes restrained in a limited area near its right hand, rear corner, by means of a light, controlled pressure applied by the tip of the conical retaining element 219. Because of the continued forward motion of the transport shutter 150, the unrestrained portions of the ply continue to move, and the ply literally pivots about the lowered orienting retainer 219*a*. As the ply pivots into a precise forward edge orientation, as reflected in FIG. 24, the left hand photocell beam 203*b* is broken, the left hand rear rotary acting solenoid 213 is actuated and the left hand orienting retainer element 219*b* is instantly brought downward into contact with the ply in the region of its trailing edge. Even at this stage, there is typically at least some additional forward overtravel movement of the transport shutter 150, moving into its forward limit position. However, the fabric ply remains fixed in its oriented position by the pressure of the retaining elements 219*a*, 219*b*. During this final stage of shutter movement, the shutter simply slides underneath the stationary, oriented ply.

In the contemplated form of the apparatus, the forward limit position of the shutter 150 is controlled by a photocell sensor 221 (FIG. 3) mounted on the frame rail 92 adjacent its forward end. The sensor 221 is positioned over the top of the left side guide rod 170 for the transport shutter and is arranged to sense the arrival of the front left slide bearing 171, attached to the shutter.

The utilization of solenoid actuators for operating the orienting fingers 216, 207 is particularly advantageous because of the rapid and highly uniform response of a solenoid, as distinguished from a fluid actuator, for example. Since the ply is in motion as it is being advanced by the transport shutter 150, it is particularly significant to have uniform response times between interruption of the photocell beam 203 and engagement of the ply by the associated rear orienter retaining elements 219. Solenoid actuators are also advantageous in that the holding pressure applied by the conical retaining elements 219, 211 can be accurately controlled by regulating the applied voltage to the solenoid activators. To advantage, the rotary acting solenoids may be Ledex rotary solenoids, Model No. H-1244-032, for example.

In order to remove the fabric ply from the transport shutter 150, the ply is held in its oriented position while the transport shutter is retracted back toward its load position. To this end, the forward set of orienting fingers 207 are lowered, by operation of the rotary acting solenoids 204, to bring the orienting restrainers 211*a*, 211*b* (FIG. 25) into contact with the ply near its leading edge. Desirably, the rearward orienting fingers 216 are elevated at an appropriate time after lowering of the forward orienting fingers, so that the fabric ply is engaged only near its leading edge 212. When the transport shutter 150 is then actuated to move in the return direction, the fabric ply is held stationary while the shutter is retracted out from under it. The ply retains its oriented position and is eventually deposited in such condition on an index conveyor, as will be described.

In connection with the above, it is significant that, in the handling of limp materials, the ply be engaged near its trailing edge 220, when the transport shutter is moving forward, and near its leading edge 212, when the transport shutter is being retracted. The ply thus always tends to be in a state of tension, rather than compression, due to the friction of movement of the shutter underneath the stationary ply. This assures that the ply is retained relatively flat, and is not caused to buckle by relative movement of the transport shutter.

In some instances, and particularly where the operating procedures involve assembly of one fabric section on top of another, edgewise alignment of the ply may be required. In the illustrated system for the assembly of two plies, it is advantageous to achieve precise edge alignment of one of the plies, while it is still on the transport shutter 150. Accurate edge alignment of the other ply can be achieved by manipulation of the index conveyor, as will be described hereinafter.

Figure 24:
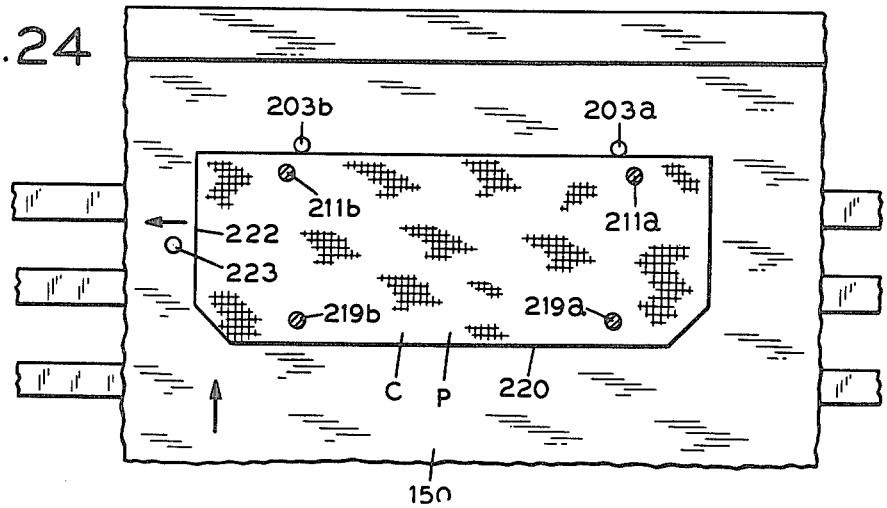
Figure 25:
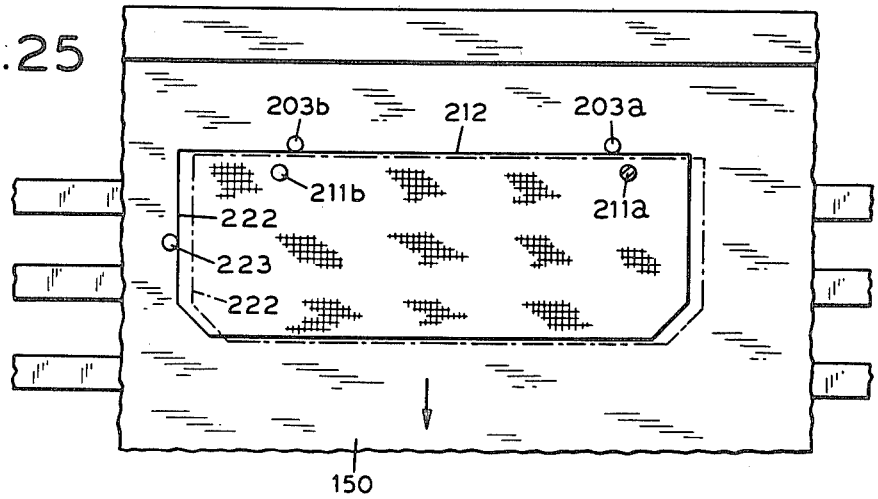

Pursuant to one aspect of the invention, in a system operating to effect simultaneous delivery of a pair of fabric plies, for orientation, alignment and assembly, such as in a production operation for the assembly and hemming of a lined shirt sleeve cuff, it is suitable to effect controlled edge alignment of the cuff ply C only, while the plies are retained on the transport shutter. As will be further described, appropriate edge alignment of the liner ply L can be effected independently on the index conveyor facility. Referring now to FIGS. 24 and 25, at this stage of the process, the left hand end edge 222 of the cuff ply C is offset to the right of its desired alignment, as established by a photocell sensor beam 223 from a photocell sensor 224 (FIG. 3). The sensor 224 is mounted on a bracket 225 capable of lateral adjustment on a support 226 mounted on the frame rail 92. The initial adjustment of the photocell 223 is such that, when the transport shutter 150 comes to rest in its forward position, with the cuff ply C being held in properly aligned position by the rearward orienting retainer elements 219, the end edge 222 of the ply will be spaced to the right of the sensor beam under all normal conditions of random ply location. Thus, under all normal operating conditions desired edge alignment can be achieved by shifting the fabric ply C to the left until its end edge is intercepted by the photocell beam 223.

Edge alignment of the ply C advantageously is effected by first lowering the forward orienting fingers 207, so that the ply is engaged not only by the back orienting retainers 219, but also by the forward retainers 211. The ply C may now be shifted bodily to the left, without changing its precise front edge orientation, by the bodily shifting (to the left) of the orienter support bar 192, physically sliding the ply C over the top surface of the stationary shutter plate 150, until the photocell beam 223 is intercepted. It will be understood, of course, that the adjacent liner ply L is also being shifted to the left at this time, by reason of its engagement with its own set of orienting elements. However, since desired end edge alignment of the liner ply is effected in a subsequent operation, the lateral motion of the oriented liner ply at this time is without consequence.

To advantage, the necessary limited lateral motion of the orienter support bar 192 is effected by a friction screw mechanism, illustrated in FIG. 4. An electrically controlled drive motor 230 is mounted on the frame rail 91 and is connected through a coupler 231 to the shaft 232 of a friction screw device 233. The friction screw device may be of a commercially available type, as for example furnished under the trade designation "Rohlix" linear actuator, Model 2, by the Barry Wright Corporation, Watertown, Mass. The operation of this mechanism is such that, when the shaft 232 is rotated, a carriage member 234, which is restrained against rotation by a lever 235, is advanced, as if by a screw thread, by means of sets of angularly disposed friction wheels 236. In the illustrated mechanism, the restraining lever 235 is connected to the orienter supporting bar 192 such that, when the carriage 234 is actuated linearly, by rotation of the shaft 232, the support bar 192 is shifted transversely with respect to the machine frame, carrying with it all of the orienter devices 191. In the system of the invention, after the transport shutter 150 has reached its forward positions, proper orientation of the front edges of the plies is indicated. This can commence a control sequence to lower the forward orienting fingers and to actuate the edge aligment motor 230 shifting all the orienting devices to the left. When the sensor beam 223 is interrupted, the motor 230 is stopped and is retained in its adjusted position. It is returned back to its "normal" position at a later stage in the operating cycle, after the fabric plies have been removed from the transport shutter.

Conveyor Section

Referring now to FIGS. 17–22, the conveyor section 43 of the apparatus is located generally in alignment with the forward limit position of the transport shutter 150 and includes an index conveyor section 240 and a process conveyor section 241. The index conveyor section 240 directly underlies the forward limit position of the transport shutter and includes a plurality of spaced conveyor belts 242 trained about pulley shafts 243, 244, journaled in the machine frame. The pulley shafts are arranged to define a horizontal run for the index conveyor, directly underneath and closely spaced with respect to the shutter plate 150 (see FIGS. 18, 19). The shaft 244 has fixed thereto a plurality of pulleys 245, supporting the index conveyor belts 242 at one end. The shaft 244 constitutes the drive input shaft for the index conveyor, and is driven through a spring coupling 246 and belt 247 by a synchronous electric motor 248. Since the index conveyor 243 is periodically stopped and started up, the spring coupling 246 is useful in providing for a degree of lost motion to accommodate the rapid acceleration of the synchronous motor during startup, while the mass of the index conveyor is being accelerated at a somewhat lower rate.

Desirably, the process conveyor 241 consists of a plurality of belts 249 trained about pulleys 250, which are carried on the index conveyor drive shaft 244. The pulleys 250 are arranged to idle on that shaft, so that the drive input to the process conveyor can be separately controlled.

At the front side of the index conveyor 240, adjacent the forwardmost conveyor belts 242, are gauge bar members 251, 252, which are arranged for engagement with the leading edge areas of the respective plies C, L, as deposited from the transport shutter 150. The gauge bars 251, 252 are mounted for limited adjustment in the front-to-back direction of the machine such that, when dealing with the simultaneous feeding of two plies, the gauge bars may be differentially adjusted if appropriate. As shown in FIGS. 18–22, the gauge bar 252 (which is identical in its function with the neighboring gauge bar 251) is so adjusted as to provide a vertical gauging surface 253 in substantial alignment with the photocell beam 203, in this case for the liner ply (although the same principles will obtain for the cuff ply with slightly different gauge bar adjustment). Thus, when the forward motion of the transport shutter 150 is terminated, as reflected in FIG. 19 and 20, the liner ply will be held by the respective sets of orienting fingers 207, 216 and retainer elements 211, 219, with the leading edge 212 of the ply substantially directly above the vertical gauging surface 253. As noted in FIG. 17, the gauge bar 252 extends longitudinally for a substantial distance, so as to enable alignment of the gauge bar and the ply edge 212 over a sufficient distance to assure proper gauging and stability of the ply.

With the ply L retained in its oriented position, the transport shutter 150 is moved in a retracting direction. Pursuant to the invention, the leading edge 254 of the transport shutter is beveled at a rather shallow angle to a sharp tip 255 located at the level of the bottom surface 256 of the shutter plate, just slightly above the gauge bar 251. As the tapered leading portion 254 of the transport shutter passes underneath the retaining element 211, the downward pressing action of the orienting finger will cause the retainer element 211 to follow along, down the inclined surface 254 and eventually onto a flat upwardly facing surface 257 of the gauge bar. Ideally, there is relative minimum spacing between the lower surface of the shutter and the upwardly facing surface of the gauge bar, so that there is a minimum distance of free travel of the orienting retainer element 211 between the inclined surface 254 and the upwardly facing gauge bar surface 257.

As reflected in FIG. 22, after the transport shutter 150 has been completely withdrawn beyond the orienting retainer element 211, the latter serves to hold the leading edge area of the fabric ply L on the gauge bar 251. With continued retracting movement, the transport shutter 150 eventually completely clears out from underneath the liner ply L, allowing the fabric ply to drop on to the spaced belts 242 of the index conveyor. Significantly, the precise orientation and alignment of the ply leading edge 212 has been accurately retained throughout the retracting movement of the transport shutter.

As is particularly evident in FIG. 14, the pivot axis (shaft 205) for the orienting fingers 207 is located well above and forward of the retaining tip 211. Accordingly, as the retaining tip is caused to move downward along the sloping surface 254 and on to the upwardly facing gauge surface 257, there is inherently a slight forward component of movement to the retaining element 211 as it follows an arcuate path around the axis of the shaft 205. This slight forward component serves advantageously to snug the leading edge 212 of the ply against the vertical gauge surface 253 of the gauge bar. In general, experience indicates that the accuracy of orientation achieved by the orienting fingers alone is adequate in most instances. However, the gauge bar 251, 252 provide additional assurance of precision alignment and orientation, which is sometimes useful when the equipment is operating at very high speeds.

To special advantage, a vacuum box 259 is provided under at least the forward section of the index conveyor 240. In the illustrated arrangement, this encompasses the area of the first four belts. The vacuum box 259 includes a flat plate 260 which underlies the first four index conveyor belts 242 and is provided with elongated slots 261 extending along the opposite sides of each belt. A plenum chamber 262 communicates with the slots 261 and is arranged to be evacuated through a conduit 263 leading to a vacuum source (not shown). When the equipment is in operation, the plenum chamber 262 is continuously evacuated, causing a constant inflow of air through the elongated slots 261 alongside the index conveyor belts 242. Accordingly, when a fabric ply is deposited on the index conveyor, by withdrawal of the shutter plate 150, the ply is drawn downward against the flat plate 260, being thus maintained in substantially flat condition and urged into good friction contact with the index conveyor belts 242.

When a liner ply L, being carried along the right hand side of the transpot shutter 150, is deposited on the belts of the index conveyor 240, the index conveyor is started by energizing the motor 248, and the liner ply is conveyed transversely, being held firmly in flat condition and in its original orientation by the action of the air flow into the vacuum chamber 262. Pursuant to one aspect of the invention, a photocell sensor 270 (see FIG. 17) is adjustably mounted on the machine frame, adjacent the left hand side of the index conveyor, so as to be intercepted by the left hand side edge 271 (FIG. 26) of a liner ply L being conveyed by the index conveyor 240. When the photocell sensor 270 intercepts the side edge of the liner ply, the index conveyor is immediately brought to a stop, so that now the liner ply is oriented with both its leading edge and side edge precisely aligned by reference sensors. Thus, although the cuff ply C is edge-aligned while still on the transport shutter, the liner ply L is edge-aligned after it has been deposited on the index conveyor 240.

Summary of Operation for Two Ply Assembly

Figure 28:
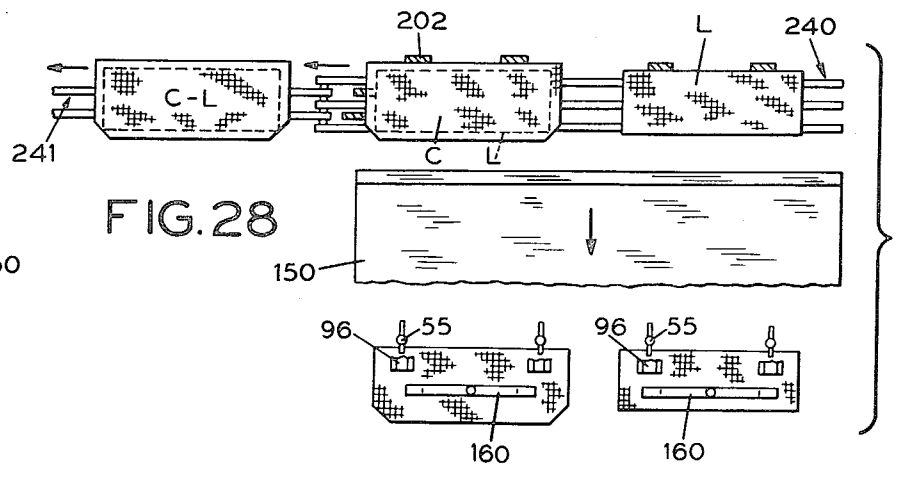
FIGS. 26–28 are sequential schematic views illustrating the procedure according to the invention for assembling fabric components, such as a cuff and liner, in preparation for a hemming operation.
Figure 26:
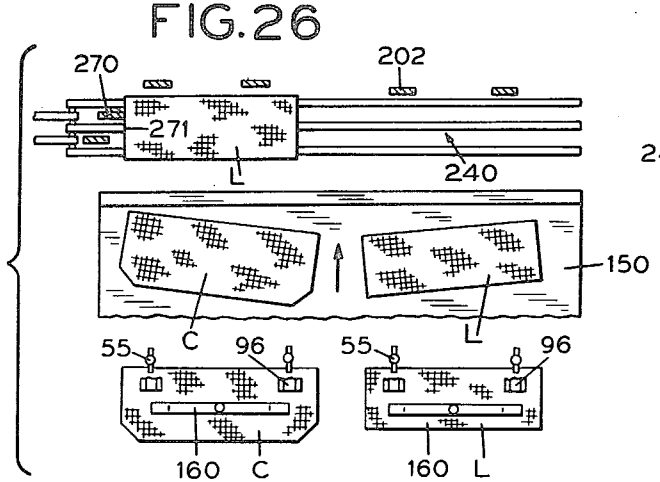
Figure 27:
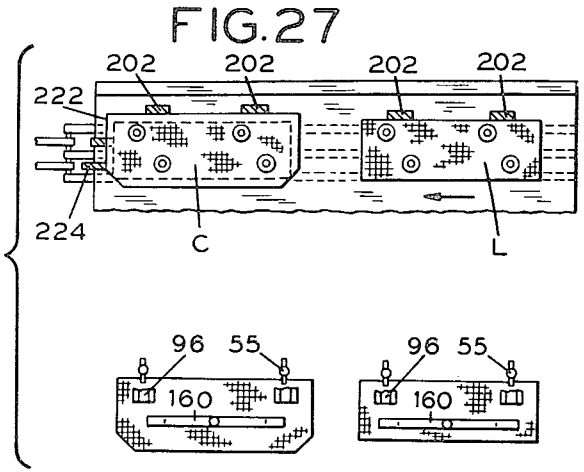

Operation of the apparatus according to the invention, to deliver aligned and assembled fabric plies, as for a lined shirt cuff, can be visualized by reference to FIGS. 26–28. It is assumed, in FIG. 26 that a previous cycle of operation has been completed, and this will leave the system with an aligned and oriented liner ply L at the delivery end of the index conveyor 240. At the time of the forward motion of the transport shutter 150, for the previous operating cycle, the rock shaft 103 has been operated to lower and then raise the several picking units 96. One pair of the picking units will have engaged and lifted a cuff ply C, at spaced areas along its leading edge, while another pair of picking units will have similarly engaged and lifted a single liner ply L. Upon the retracting movement of the transport shutter 150, to a position underneath the just-picked liner and cuff plies, the picking units execute a castoff of the plies, in the manner previously described, and the presser units 160 momentarily descend. The transport shutter 150 then advances with its unoriented, plies C, L toward the discharge position, above the index conveyor 240.

As the transport shutter 150 reaches its forward position, reflected in FIG. 27, both the liner and the cuff plies will have been oriented and positioned along their respective leading edges, by the spaced pairs of photocell sensor units 202, independently actuated in the manner heretofore described to stop first one side and then the other of an oriented ply. As reflected in FIG. 27, the adjustment of the photocell sensors for the liner ply may and typically will be somewhat different than for the cuff ply C, reflecting the fact that the cuff ply is somewhat larger than the liner and is intended to overlap the latter when eventually assembled therewith. At this stage, edge alignment of the cuff ply is effected by bodily shifting to the left of the orienter support bar 192, until the ply edge 222 is detected by the photocell sensor 224. Although the liner ply L is laterally shifted during edge alignment of the cuff ply. Only edge alignment of the cuff ply is controlled at this stage.

As reflected in FIG. 27, upon completion of the orienting and edge alignment of the cuff ply C, the cuff ply C, while still on the transport shutter 150, will directly overlie, in proper alignment, the previously oriented and edge-aligned liner ply L, which remains on the index conveyor from the previous cycle. Accordingly, when the transport shutter 150 is now retracted (see FIG. 28) to pick up the next pair of plies from the picking units 96, the aligned and oriented cuff ply C will be deposited onto the index conveyor, directly on top of the liner ply L from the previous cycle, and then the assembled plies will be held on the index conveyor by the action of the vacuum box arrangement. At the same time, an oriented but non-edge-aligned liner ply L will be deposited from the shutter onto the right hand side of the index conveyor. At this stage, both the index conveyor 240 and the production conveyor 241 are actuated, causing the assembled ply stack C-L to be carried away to the left, to be sewed, hemmed or otherwise processed. The just-deposited liner ply L is conveyed into space vacated by the ply assembly C-L, and is edge-aligned by interception of its left side edge with the photocell 270 (see FIG. 26).

Summary of Operation for Single Ply Delivery

The apparatus specifically illustrated herein, while intended primarily for the picking, delivery and assembly of two plies of material, is alternatively useful for the delivery to a processing operation, such as hemming, of a single, relatively large ply of fabric. In the schematic illustration of FIG. 29, the equipment is set up for the handling of sleeve plies S for short sleeved shirts. The plies S are of substantial size, in both length and width dimensions. In particular, the plies S are of sufficient width to overlap both of the supply elevator platforms 44, 45. Whereas the machine is equipped with two sets of picking units 96 associated with each of the elevator platforms, it is contemplated that, for utilization with single, large plies, some of the picking units will be disabled. This may be conveniently done by either disconnecting the operating rods 101 for the disabled units, so that those units are not lowered when their rock shaft 103 is actuated. Alternatively the disabled units may be set up to be lifted and lowered with the operative units while having their wheel-actuating cylinders 130 deactivated. In general, although a particular ply S may be sufficiently wide to accommodate three or even all four of the picking units, it is generally preferred to utilize the least necessary number. If necessary, the loction of the operative picking units may be adjusted laterally on the support shafts 95, so that the picking units may have an optimum location with respect to any given fabric ply. The optimum location in any given instance can be a function of both the dimensions of the ply and its physical characteristics, and can be easily determined on an empirical basis.

When operating the system to deliver large plies, extending over both of the elevator platforms 44, 45, it is preferred that the elevation control for each of the platforms be independently controlled according to its own height sensor (FIG. 6) to assure that the ply will have the proper level directly underneath the picking units in each instance. In some cases, this may require the platforms 44, 45 to be on different levels to compensate for thickness variations over the surfaces of the plies.

Figure 29:
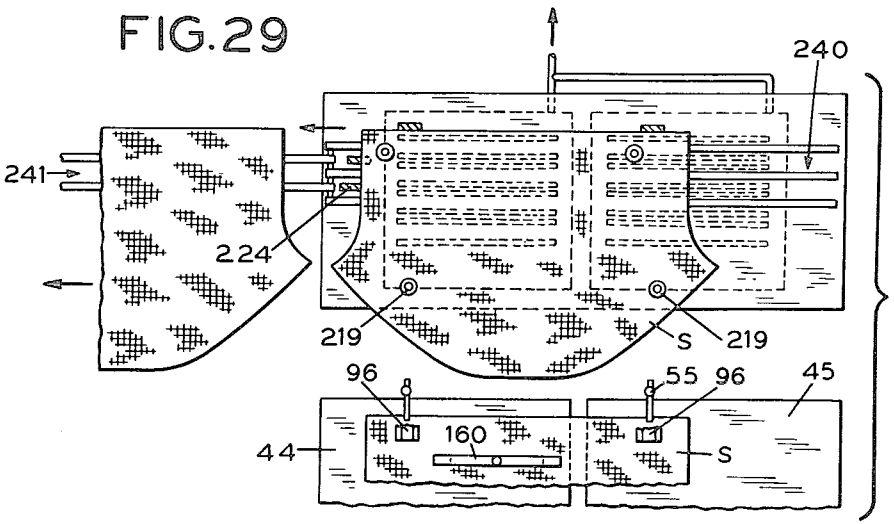
FIG. 29 is a simplified schematic representation illustrating the manner of using the apparatus of the invention for the delivery of a single, relatively large fabric ply in oriented and aligned relation.

As reflected in FIG. 29, when the equipment is set up for large ply operation, selected ones of the orienting assemblies 191 are disabled, and only two such assemblies are utilized in the orientation of the ply, one adjacent each side edge of the ply. If necessary, the orienting assemblies may be adjusted laterally on the support shaft 192, in order to achieve optimum alignment of the orienters with respect to the fabric ply S. In addition, the rearward set of orienting fingers 216 (see FIG. 14) typically will have to be exchanged for longer fingers (not specifically shown), so that the retainer elements 219 can engage the fabric ply near its trailing edge area during the orientation of the leading edge. In general, it is not necessary to change or adjust the forward set of orienting fingers 207, because the oriented location of the leading edge of the ply typically changes relatively little from one type of ply to another.

Leading edge alignment and deposit of the large ply S is accomplished substantially in the same manner as with the smaller individual plies previously described. In general, when dealing with a single ply, it is not necessary to effect side edge alignment prior to discharging the ply on to the production conveyor 241. However, if side edge alignment is necessary or desirable in a given instance, it can be accomplished either on the transport shutter 150, by the procedure used with respect to the individual cuff plies C, or on the index conveyor 240, in the manner utilized for the individual liner plies L.

One of the significant advantages of the invention is the wide versatility of the equipment. Utilizing a plurality of picking units, in conjunction with a generally flat transport shutter, it is possible to pick and deliver individual plies of a wide variety of sizes and shapes. In a machine incorporating several picking units, the individual units may be adjustably positioned and selectively disabled such that optimum positioning of the pickup units is achievable with a wide variety of sizes and shapes of fabric plies. With the system of the invention, a pair of picking units functions to engage, at spaced areas, and to lift the forward edge area of a fabric ply. This enables a transport shutter plate to be inserted underneath the leading edge, separating the rest of the ply from the stack and providing the means for transporting the ply to a load station.

Another particularly important advantage of the invention resides in the provision of arrangements for optically controlled orientation of the fabric ply at the destination position. With this arrangement, ply stack variations, as well as any shift in ply position occurring during the forward transport of the ply on the shutter, are completely isolated, as the ply orientation does not occur unitl the ply reaches the discharge position, at the load station. A combination of means for optically detecting the leading edge of the ply and means for restraining the trailing edge of the ply, during the last stages of forward movement of the transport shutter, provides for the highly accurate alignment and orientation of a fabric ply, even of very limp and flimsy material.

With the system of the invention, a pair of plies for assembly may be separately picked from individual stacks thereof and deposited for transport on a common shutter plate. When these individual plies reach the load station, they are individually oriented and aligned for assembly. Pursuant to the invention, individual adjustment of the alignment and orientation of each ply is provided for, and provision is made for "fine tuning" adjustment while the equipment is in operation. This enables the machine operator to observe the relative alignment of assembled plies. If adjustments are needed, either in angular orientation, front edge positioning, or side edge positioning, the necessary adjustments may be made by manipulation of manual adjusting screws to effect appropriate repositioning of the photocell sensors.

When the equipment is set up for assembly of one fabric ply with another, the use of a vacuum assisted index conveyor is particularly advantageous in providing for continued control of the previously aligned and oriented plies. Thus, a liner ply, deposited on the upstream side of the index conveyor, is gripped firmly by the index conveyor belts while being held snugly thereagainst in a flat condition by the vacuum action. This enables precise alignment of the end edge of the liner ply, by control of the index conveyor movement. When a previously aligned and oriented cuff ply is deposited on the liner ply, the two parts are held in a precision-assembled relation, until the assembly is discharged from the index conveyor on to a production conveyor. In accordance with known techniques, the production conveyor typically includes opposed pairs of upper and lower belts, so that the assembled plies are held together until the sewing or other joining operation is complete.

The equipment specifically illustrated herein is particularly advantageous for the production of short sleeved and long sleeved shirts, for example. In general, there is a seasonal character to the manufacture of long sleeved and short sleeved shirts, which the equipment of the present apparatus can accommodate by its versatility. During one season, the equipment may be utilized in the production of lined cuff assemblies for long sleeved shirts. During the alternate seasons, by means of an easily accomplished adjustment and alteration of the equipment, it may be setup for the high speed feeding of short sleeve plies. Thus, although the machine has certain highly specific capabilities, it is also sufficiently versatile that it may be maintained in full production use for a wide variety of operations.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. Apparatus for picking and feeding plies of limp material one at a time from each of one or more stacks thereof, which comprises (a) at least one ply stack supporting and elevating platform, (b) at least two ply picking and lifting units arranged above each ply stack and engageable with widely spaced areas of the uppermost ply thereof, (c) each of said picking and lifting units comprising a lifting arm, a ply engageable wheel carried by said arm, and a ply engaging shoe engageable with the uppermost ply of a stack, (d) means pivotally mounting the lifting arms of each picking unit for movement of the wheel and shoe toward and away from the ply stack, and (e) actuating means for said picking units including a common actuator for all of said picking units and a plurality of individual, independently adjustable resilient connecting means interposed between said common actuator and said individual picking units.

2. Apparatus according to claim 1, further characterized by (a) said adjustable resilient connecting means comprising a connecting rod attached to one of said common actuator or said individual picking units at one end and slideably engaging the other of said common actuator or said individual picking units at its other end, (b) a compressible coil spring on said rod acting against the element at the slideable end of the rod, and (c) means for adjustably pre-compressing said coil spring.

3. Apparatus according to claim 1, further characterized by (a) a fixed common mounting shaft for pivotally mounting each of the individual picking units, and (b) individually adjustable counterbalancing springs connecting each picking unit to said fixed mounting shaft and individually adjusted to provide substantial rotary balance to each of said picking units.

4. Apparatus according to claim 3, further characterized by (a) said individual picking units being slideably adjustable transversely on said common mounting shaft.

* * * * *